US007699314B2

(12) United States Patent
Bozeman

(10) Patent No.: US 7,699,314 B2
(45) Date of Patent: Apr. 20, 2010

(54) LOTTERY GAME UTILIZING NOSTALGIC GAME THEMES

(75) Inventor: Alan Kyle Bozeman, Alpharetta, GA (US)

(73) Assignee: Scientific Games International, Inc., Newark, DE (US)

( * ) Notice: Subject to any disclaimer, the term of this patent is extended or adjusted under 35 U.S.C. 154(b) by 897 days.

(21) Appl. No.: 11/327,608

(22) Filed: Jan. 6, 2006

(65) Prior Publication Data

US 2006/0151943 A1 Jul. 13, 2006

Related U.S. Application Data

(60) Provisional application No. 60/642,242, filed on Jan. 7, 2005.

(51) Int. Cl.
*A63B 71/00* (2006.01)

(52) U.S. Cl. ..... 273/138.1

(58) Field of Classification Search ..... None
See application file for complete search history.

(56) References Cited

U.S. PATENT DOCUMENTS

| | | | |
|---|---|---|---|
| 1,527,929 | A | 2/1925 | Simons |
| 3,089,123 | A | 5/1963 | Hennis et al. |
| 3,245,697 | A | 4/1966 | BNugent |
| 3,699,311 | A | 10/1972 | Dunbar |
| 3,736,368 | A | 5/1973 | Vogelman et al. |
| 3,826,499 | A | 7/1974 | Lenkoff |
| 3,868,057 | A | 2/1975 | Chavez |
| 3,876,865 | A | 4/1975 | Bliss |
| 3,902,253 | A | 9/1975 | Sabuzawa et al. |
| 3,918,174 | A | 11/1975 | Miller et al. |
| 3,922,529 | A | 11/1975 | Orloff |
| 3,934,120 | A | 1/1976 | Maymarev |
| 4,017,834 | A | 4/1977 | Cuttill et al. |
| 4,095,824 | A | 6/1978 | Bachman |
| 4,105,156 | A | 8/1978 | Dethloff |
| 4,176,406 | A | 11/1979 | Matkan |

(Continued)

FOREIGN PATENT DOCUMENTS

| | | |
|---|---|---|
| AU | 529535 | 6/1983 |

(Continued)

OTHER PUBLICATIONS

'Are You in?', (Article).

(Continued)

*Primary Examiner*—Gene Kim
*Assistant Examiner*—Dolores Collins
(74) *Attorney, Agent, or Firm*—Dority & Manning, P.A.

(57) ABSTRACT

A method for hosting and playing a lottery game using nostalgic game themes. The lottery game, in one embodiment emulating Pac-Man®, comprises a player selecting a path on a grid, and a lottery populating the path with numbers either generated randomly or selected by the player. The lottery also randomly places few ghosts on the same grid. A set of player indicia is determined by the numbers on the path before the path intercept with one or more ghosts. The set of player indicia is then compared with a set of winning indicia and the player receives a prize depending on the number of matches between the player indicia and winning indicia.

8 Claims, 26 Drawing Sheets

U.S. PATENT DOCUMENTS

| | | | |
|---|---|---|---|
| 4,191,376 | A | 3/1980 | Goldman et al. |
| 4,194,296 | A | 3/1980 | Pagnozzi et al. |
| 4,195,772 | A | 4/1980 | Nishimura |
| 4,206,920 | A | 6/1980 | Weatherford et al. |
| 4,241,942 | A | 12/1980 | Bachman |
| 4,243,216 | A | 1/1981 | Mazumder |
| 4,273,362 | A | 6/1981 | Carrier et al. |
| 4,309,452 | A | 1/1982 | Sachs |
| 4,313,087 | A | 1/1982 | Weitzen et al. |
| 4,355,300 | A | 10/1982 | Weber |
| 4,375,666 | A | 3/1983 | Buck et al. |
| 4,398,708 | A | 8/1983 | Goldman et al. |
| 4,407,443 | A | 10/1983 | McCorkle |
| 4,451,759 | A | 5/1984 | Heynisch |
| 4,455,039 | A | 6/1984 | Weitzen et al. |
| 4,457,430 | A | 7/1984 | Darling et al. |
| 4,464,423 | A | 8/1984 | LaBianca et al. |
| 4,466,614 | A | 8/1984 | Bachman et al. |
| 4,488,646 | A | 12/1984 | McCorkle |
| 4,491,319 | A | 1/1985 | Nelson |
| 4,494,197 | A | 1/1985 | Troy et al. |
| 4,536,218 | A | 8/1985 | Ganho |
| 4,544,184 | A | 10/1985 | Freund et al. |
| 4,579,371 | A | 4/1986 | Long et al. |
| 4,591,189 | A | 5/1986 | Holmen et al. |
| 4,634,149 | A | 1/1987 | Donovan |
| 4,665,502 | A | 5/1987 | Kreisner |
| 4,669,729 | A | 6/1987 | Solitt et al. |
| 4,689,742 | A | 8/1987 | Troy et al. |
| 4,726,608 | A | 2/1988 | Walton |
| 4,736,109 | A | 4/1988 | Dvorzsak |
| 4,738,473 | A | 4/1988 | Meloni et al. |
| 4,740,016 | A | 4/1988 | Konecny et al. |
| 4,760,247 | A | 7/1988 | Keane et al. |
| 4,763,927 | A | 8/1988 | Schneider |
| 4,775,155 | A | 10/1988 | Lees |
| 4,792,667 | A | 12/1988 | Chen |
| 4,805,907 | A | 2/1989 | Hagiwara |
| 4,817,951 | A | 4/1989 | Crouch et al. |
| 4,835,624 | A | 5/1989 | Black et al. |
| 4,836,546 | A | 6/1989 | DiRe et al. |
| 4,836,553 | A | 6/1989 | Suttle et al. |
| 4,837,728 | A | 6/1989 | Barrie et al. |
| 4,856,787 | A | 8/1989 | Itkis |
| 4,861,041 | A | 8/1989 | Jones et al. |
| 4,870,260 | A | 9/1989 | Niepolomski et al. |
| 4,880,964 | A | 11/1989 | Donahue |
| 4,888,964 | A | 12/1989 | Klinge |
| 4,922,522 | A | 5/1990 | Scanlon |
| 4,943,090 | A | 7/1990 | Fienberg |
| 4,960,611 | A | 10/1990 | Fujisawa et al. |
| 4,961,578 | A | 10/1990 | Chateau |
| 4,964,642 | A | 10/1990 | Kamille |
| 4,996,705 | A | 2/1991 | Entenmann et al. |
| 4,998,010 | A | 3/1991 | Chandler et al. |
| 4,998,199 | A | 3/1991 | Tashiro et al. |
| 5,032,708 | A | 7/1991 | Comerford et al. |
| 5,037,099 | A | 8/1991 | Burtch |
| 5,046,737 | A | 9/1991 | Fienberg |
| 5,074,566 | A | 12/1991 | Desbiens |
| 5,083,815 | A | 1/1992 | Scrymgeour et al. |
| 5,092,598 | A | 3/1992 | Kamille |
| 5,094,458 | A | 3/1992 | Kamille |
| 5,100,139 | A | 3/1992 | Di Bella |
| 5,109,153 | A | 4/1992 | Johnsen et al. |
| 5,112,050 | A | 5/1992 | Koza et al. |
| 5,116,049 | A | 5/1992 | Sludikoff et al. |
| 5,118,109 | A | 6/1992 | Gumina |
| 5,119,295 | A | 6/1992 | Kapur |
| 5,158,293 | A | 10/1992 | Mullins |
| 5,165,967 | A | 11/1992 | Theno et al. |
| 5,186,463 | A | 2/1993 | Marin et al. |
| 5,189,292 | A | 2/1993 | Batterman et al. |
| 5,193,815 | A | 3/1993 | Pollard |
| 5,193,854 | A | 3/1993 | Borowski, Jr. et al. |
| 5,228,692 | A | 7/1993 | Carrick et al. |
| 5,232,221 | A | 8/1993 | Sludikoff et al. |
| 5,234,798 | A | 8/1993 | Heninger et al. |
| 5,249,801 | A | 10/1993 | Jarvis |
| 5,259,616 | A | 11/1993 | Bergmann |
| 5,273,281 | A | 12/1993 | Lovell |
| 5,276,980 | A | 1/1994 | Carter et al. |
| 5,282,620 | A | 2/1994 | Keesee |
| 5,308,992 | A | 5/1994 | Crane et al. |
| 5,317,135 | A | 5/1994 | Finocchio |
| 5,326,104 | A | 7/1994 | Pease et al. |
| 5,332,219 | A | 7/1994 | Marnell, II et al. |
| 5,342,047 | A | 8/1994 | Hiedel et al. |
| 5,342,049 | A | 8/1994 | Wichinsky et al. |
| 5,344,144 | A | 9/1994 | Canon |
| 5,346,258 | A | 9/1994 | Behn et al. |
| 5,380,007 | A | 1/1995 | Travis et al. |
| 5,393,057 | A | 2/1995 | Marnell, II et al. |
| 5,401,024 | A | 3/1995 | Simunek |
| 5,403,039 | A | 4/1995 | Borowski, Jr. et al. |
| 5,407,199 | A | 4/1995 | Gumina |
| 5,411,260 | A | 5/1995 | Smith |
| 5,420,406 | A | 5/1995 | Izawa et al. |
| 5,432,005 | A | 7/1995 | Tanigami et al. |
| 5,451,052 | A | 9/1995 | Behm et al. |
| 5,453,602 | A | 9/1995 | Hanada |
| 5,456,465 | A | 10/1995 | Durham |
| 5,471,040 | A | 11/1995 | May |
| 5,475,205 | A | 12/1995 | Behm et al. |
| 5,486,005 | A | 1/1996 | Neal |
| 5,513,846 | A | 5/1996 | Niederlein et al. |
| 5,528,154 | A | 6/1996 | Leichner et al. |
| 5,536,016 | A | 7/1996 | Thompson |
| 5,540,442 | A | 7/1996 | Orselli et al. |
| 5,548,110 | A | 8/1996 | Storch et al. |
| 5,550,746 | A | 8/1996 | Jacobs |
| 5,560,610 | A | 10/1996 | Behm et al. |
| 5,564,700 | A | 10/1996 | Celona |
| 5,564,977 | A | 10/1996 | Algie |
| 5,591,956 | A | 1/1997 | Longacre, Jr. et al. |
| 5,599,046 | A | 2/1997 | Behm et al. |
| 5,602,381 | A | 2/1997 | Hoshino et al. |
| 5,621,200 | A | 4/1997 | Irwin et al. |
| 5,628,684 | A | 5/1997 | Bouedec |
| 5,630,753 | A | 5/1997 | Fuchs |
| 5,651,735 | A | 7/1997 | Baba |
| 5,655,961 | A | 8/1997 | Acres et al. |
| 5,667,250 | A | 9/1997 | Behm et al. |
| 5,682,819 | A | 11/1997 | Beaty |
| 5,690,366 | A | 11/1997 | Luciano |
| 5,704,647 | A | 1/1998 | Desbiens |
| 5,722,891 | A | 3/1998 | Inoue |
| 5,726,898 | A | 3/1998 | Jacobs |
| 5,732,948 | A | 3/1998 | Yoseloff |
| 5,741,183 | A | 4/1998 | Acres et al. |
| 5,743,800 | A | 4/1998 | Huard et al. |
| 5,752,882 | A | 5/1998 | Acres et al. |
| 5,756,220 | A | 5/1998 | Hoshino et al. |
| 5,768,142 | A | 6/1998 | Jacobs |
| 5,769,458 | A | 6/1998 | Carides et al. |
| 5,770,533 | A | 6/1998 | Franchi |
| 5,772,509 | A | 6/1998 | Weiss |
| 5,772,510 | A | 6/1998 | Roberts |
| 5,772,511 | A | 6/1998 | Smeltzer |
| RE35,864 | E | 7/1998 | Weingardt |
| 5,779,840 | A | 7/1998 | Boris |
| 5,789,459 | A | 8/1998 | Inagaki et al. |
| 5,791,990 | A | 8/1998 | Schroeder et al. |
| 5,797,794 | A | 8/1998 | Angell |

5,803,504 A 9/1998 Deshiens et al.
5,816,920 A 10/1998 Hanai
5,818,019 A 10/1998 Irwin, Jr. et al.
5,820,459 A 10/1998 Acres et al.
5,823,874 A 10/1998 Adams
5,830,063 A 11/1998 Byrne
5,830,066 A 11/1998 Goden et al.
5,830,067 A 11/1998 Graves et al.
5,833,537 A 11/1998 Barrie
5,835,576 A 11/1998 Katz et al.
5,836,086 A 11/1998 Elder
5,836,817 A 11/1998 Acres et al.
5,848,932 A 12/1998 Adams
5,863,075 A 1/1999 Rich et al.
5,871,398 A 2/1999 Schneier et al.
5,876,284 A 3/1999 Acres et al.
5,882,261 A 3/1999 Adams
5,883,537 A 3/1999 Luoni et al.
5,885,158 A 3/1999 Torango et al.
5,887,906 A 3/1999 Sultan
5,903,340 A 5/1999 Lawady et al.
5,911,418 A 6/1999 Adams
5,915,588 A 6/1999 Stoken et al.
5,934,671 A 8/1999 Harrison
5,935,002 A 8/1999 Falciglia
5,970,143 A 10/1999 Schneier et al.
5,979,894 A 11/1999 Alexoff
5,996,997 A 12/1999 Kamille
5,997,044 A 12/1999 Behm et al.
6,003,307 A 12/1999 Naber et al.
6,004,207 A 12/1999 Wilson, Jr. et al.
6,007,162 A 12/1999 Hinz et al.
6,012,982 A 1/2000 Piechowiak et al.
6,014,032 A 1/2000 Maddix et al.
6,017,032 A 1/2000 Grippo et al.
6,024,641 A 2/2000 Sarno
6,053,405 A 4/2000 Irwin, Jr. et al.
6,077,162 A 6/2000 Weiss
6,080,062 A 6/2000 Olson
6,086,477 A 7/2000 Walker et al.
6,089,978 A 7/2000 Adams
6,099,407 A 8/2000 Parker, Jr. et al.
6,102,400 A 8/2000 Scott et al.
6,107,913 A 8/2000 Gatto et al.
6,119,364 A 9/2000 Elder
6,125,368 A 9/2000 Bridge et al.
6,142,872 A 11/2000 Walker et al.
6,146,272 A 11/2000 Walker et al.
6,149,521 A 11/2000 Sanduski
6,155,491 A 12/2000 Dueker et al.
6,168,521 B1 1/2001 Luciano et al.
6,168,522 B1 1/2001 Walker et al.
6,176,487 B1 * 1/2001 Eklund et al. ..... 273/249
6,179,710 B1 1/2001 Sawyer et al.
6,203,430 B1 3/2001 Walker et al.
6,206,373 B1 3/2001 Garrod
6,210,275 B1 4/2001 Olsen
6,217,448 B1 4/2001 Olsen
6,220,596 B1 4/2001 Horan
6,220,961 B1 4/2001 Keane et al.
6,224,055 B1 5/2001 Walker et al.
6,227,969 B1 5/2001 Yoseloff
6,238,288 B1 5/2001 Walker et al.
6,309,300 B1 10/2001 Glavich
6,312,334 B1 11/2001 Yoseloff
6,315,291 B1 11/2001 Moody
6,330,976 B1 12/2001 Dymetman et al.
6,331,143 B1 12/2001 Yoseloff
6,334,814 B1 1/2002 Adams
6,340,158 B2 1/2002 Pierce et al.
6,368,213 B1 4/2002 McNabola
6,375,568 B1 4/2002 Roffman et al.
6,379,742 B1 4/2002 Behm et al.
6,394,899 B1 5/2002 Walker et al.
6,398,214 B1 6/2002 Moteki et al.
6,398,643 B1 * 6/2002 Knowles et al. ..... 463/17
6,398,644 B1 * 6/2002 Perrie et al. ..... 463/18
6,398,645 B1 6/2002 Yoseloff
6,416,408 B2 7/2002 Tracy et al.
6,419,579 B1 7/2002 Bennett
6,435,408 B1 8/2002 Irwin, Jr. et al.
6,435,500 B2 8/2002 Gumina
6,478,677 B1 11/2002 Moody
6,491,215 B1 12/2002 Irwin, Jr. et al.
6,497,408 B1 12/2002 Walker et al.
6,514,144 B2 * 2/2003 Riendeau et al. ..... 463/42
6,552,290 B1 4/2003 Lawandy
6,588,747 B1 7/2003 Seelig
6,599,186 B1 7/2003 Walker et al.
6,601,772 B1 8/2003 Rubin et al.
6,637,747 B1 10/2003 Garrod
6,645,071 B2 * 11/2003 Perrie et al. ..... 463/16
6,648,735 B2 11/2003 Miyashita et al.
6,648,753 B1 11/2003 Tracy et al.
6,648,755 B1 11/2003 Luciano et al.
6,676,126 B1 1/2004 Walker et al.
6,692,354 B2 2/2004 Tracy et al.
6,702,047 B2 3/2004 Huber
6,773,345 B2 8/2004 Walker et al.
6,776,337 B2 8/2004 Irwin, Jr. et al.
6,786,824 B2 9/2004 Cannon
6,823,874 B2 11/2004 Lexcen
6,855,055 B2 * 2/2005 Perrie et al. ..... 463/29
6,875,105 B1 4/2005 Behm et al.
6,929,186 B2 8/2005 Lapstun
6,988,948 B2 * 1/2006 Perrie et al. ..... 463/25
2001/0027130 A1 10/2001 Namba et al.
2001/0030978 A1 10/2001 Holloway et al.
2001/0034262 A1 10/2001 Banyai
2001/0040345 A1 11/2001 Au-Yeung
2002/0022511 A1 2/2002 Eklund et al.
2002/0082071 A1 6/2002 Reindeau et al.
2002/0084335 A1 7/2002 Ericson
2002/0171201 A1 11/2002 Au-Yeung
2002/0187825 A1 12/2002 Tracy et al.
2003/0050109 A1 3/2003 Caro et al.
2003/0114210 A1 6/2003 Meyer et al.
2004/0036212 A1 2/2004 Walker et al.
2004/0076310 A1 4/2004 Hersch et al.
2004/0173965 A1 9/2004 Stanek
2004/0178579 A1 9/2004 Lowell et al.
2004/0178582 A1 9/2004 Garrod
2004/0185931 A1 9/2004 Hartman et al.
2004/0204222 A1 10/2004 Roberts
2004/0229674 A1 11/2004 Thomas
2004/0259631 A1 12/2004 Katz et al.
2004/0266514 A1 12/2004 Penrice

FOREIGN PATENT DOCUMENTS

AU 529536 6/1983
AU B-18428/92 12/1992
AU B-21070/92 7/1993
AU A-50327/96 2/1997
AU B-52499/96 2/1997
AU 199716432 B2 9/1997
AU A-45403/97 4/1998
AU A-63553/98 10/1998
DE 2938307 C2 4/1981
DE 3035898 A1 4/1982
DE 3035947 A1 5/1982
DE 2938307 C3 6/1982
DE 29803107 U1 8/1988
DE 3822636 A1 1/1990
DE 2938307 C3 8/1990
DE 3822636 A1 1/1992

| | | | |
|---|---|---|---|
| DE | 3415114 | A1 | 10/1995 |
| DE | 19646956 | C1 | 5/1998 |
| DE | 19706286 | A1 | 5/1998 |
| DE | 29816453 | U1 | 4/1999 |
| DE | 19751746 | A1 | 5/1999 |
| EP | 0122902 | B1 | 4/1984 |
| EP | 0333934 | A1 | 9/1989 |
| EP | 0458623 | | 11/1991 |
| EP | 0798676 | A1 | 10/1997 |
| EP | 0799649 | A1 | 10/1997 |
| EP | 0149712 | A2 | 7/1998 |
| EP | 0874337 | A1 | 10/1998 |
| EP | 0896304 | A2 | 2/1999 |
| EP | 0914875 | A2 | 5/1999 |
| EP | 0914875 | A3 | 5/1999 |
| EP | 0919965 | A2 | 6/1999 |
| EP | 0983801 | A2 | 3/2000 |
| EP | 0983801 | A3 | 3/2001 |
| EP | 1149712 | A1 | 10/2001 |
| ES | 2006400 | | 4/1989 |
| ES | 2006401 | | 4/1989 |
| GB | 642892 | A | 9/1950 |
| GB | 1495121 | A | 12/1977 |
| GB | 2075918 | A | 11/1981 |
| GB | 2222712 | B | 3/1990 |
| GB | 2230373 | A | 10/1990 |
| GB | 2295775 | A | 12/1996 |
| GB | 3328311 | | 2/1999 |
| GB | 23282311 | A | 2/1999 |
| GB | 2 383 544 | | 7/2003 |
| JP | 02235744 | | 9/1990 |
| JP | 04132672 | | 5/1992 |
| WO | WO85/02250 | A1 | 5/1985 |
| WO | WO91/17529 | | 11/1991 |
| WO | WO 98/03910 | | 1/1998 |
| WO | WO 98/40138 | | 9/1998 |
| WO | WO 99/09364 | A1 | 2/1999 |
| WO | WO 99/26204 | | 5/1999 |
| WO | WO 99/39312 | | 8/1999 |
| WO | WO00/00256 | | 1/2000 |
| WO | WO00/78418 | A1 | 12/2000 |
| WO | WO01/74460 | A2 | 11/2001 |
| WO | WO01/93966 | A1 | 12/2001 |
| WO | WO02/056266 | A1 | 7/2002 |
| WO | WO 02087713 | A1 | 11/2002 |

OTHER PUBLICATIONS

'Beginner's Guide—How to Bet', (www.plimico.com/How+to+wager/beginnersguide/), (Internet Article), 3 Pgs.
Chip Brown, 'Austin American-Statesman', (Article), May 28, 1998, 2 Pgs., Texas.
John C. Hallyburton, Jr., 'Frequently Asked Questions About Keno', (Internet Article), 1995, 1998, 10 Pgs., (http://conielco.com/faq/keno.html).
'Horse betting Tutorial—Types of Bets' (www.homepokergames.com/horsebettingtutorial.php), (Internet Article), 2 Pgs.
Judith Gaines, 'Pool Party Betting Business Booming Throughout Area Workplaces', (Internet Article), Mar. 19, 1994, 2 Pgs., Issue 07431791, Boston Globe, Boston, MA.
'Maryland Launches Let It Ride', (Internet Article), Circa 2001,1 Pg.
'Notice of Final Rulemaking', (Internet Article) Mar. 24, 2000, 10 Pgs., vol. 6, Issue #13, Arizona Administrative Register, Arizona.
'How to Play Megabucks', (Internet Article), Mar. 9, 2001, 2 Pgs., Oregon Lottery Megabucks,(http://www.oregonlottery.org/mega/m_howto.htm).
'How to Play Megabucks', (Internet Article), May 8, 2001, 2 Pgs., Oregon Lottery Megabucks, (http://www.oregonlottery.org/mega/m_howto.htm).
'Oregon Lottery', (Internet Article), Apr. 30, 2004, 9 Pgs., Oregon Lottery Web Center, (http://www.oregonlottery.org/general/g_hist.shtml).
'Powerball Odd & Prizes', 'How to Play Powerball', (Internet Article),Dec. 2002, 2 Pgs., (www.powerball.com/pbhowtoplay.shtm).
'Powerball Prizes and Odds', (Internet Article), 2 Pgs., http://www.powerball.com/pbprizesNOdds.shtm.
'Learn To Play the Races' (Internet Article), 15 Pgs., Racing Daily Form (www.drf.com).
Mike Parker, 'The History of Horse Racing' (Internet Article),1996,1997,1998, 5 Pgs., http://www.mrmike.com/explore/hrhist.htm.
EPO Search Report, Apr. 16, 2009.
International Search Report and Written Opinion Sep. 27, 2007 for PCT US06/00583.

* cited by examiner

| Matches | Prizes | Odds | Return |
|---|---|---|---|
| 4 | $599 | 1 in 2,510.7 | 11.9% |
| 3 | $50 | 1 in 92.6 | 27.0% |
| 2 | $5 | 1 in 9.9 | 25.2% |

FIG. 19

| Matches | Probability |
|---|---|
| 4 | 0.0000109421 |
| 3 | 0.0015756647 |
| 2 | 0.0413611993 |
| 1 | 0.3125068388 |
| 0 | 0.6445453551 |

Case 1: 4 Numbers

FIG. 20

| Matches | Probability |
|---|---|
| 4 | 0.0000547106 |
| 3 | 0.0038297407 |
| 2 | 0.0651055914 |
| 1 | 0.3580807528 |
| 0 | 0.5729292045 |

Case 2: 5 Numbers

FIG. 21

| Matches | Probability |
|---|---|
| 4 | 0.0001641317 |
| 3 | 0.0074406390 |
| 2 | 0.0920779079 |
| 1 | 0.3928657402 |
| 0 | 0.5074515811 |

Case 3: 6 Numbers

FIG. 22

| Matches | Probability |
|---|---|
| 4 | 0.0003829741 |
| 3 | 0.0126381442 |
| 2 | 0.1213261845 |
| 1 | 0.4179013021 |
| 0 | 0.4477513951 |

Case 4: 7 Numbers

FIG. 23

| Matches | Probability |
|---|---|
| 4 | 0.0013787066 |
| 3 | 0.0284932706 |
| 2 | 0.1831710253 |
| 1 | 0.4426633111 |
| 0 | 0.3442936864 |

Case 5: 9 Numbers

FIG. 24

| Matches | Probability |
|---|---|
| 4 | 0.0003982930 |
| 3 | 0.0107954918 |
| 2 | 0.1006083817 |
| 1 | 0.3848035890 |
| 0 | 0.5033942444 |

General Case

FIG. 25

$2.00

Start

| | | | | |
|---|---|---|---|---|
| 30 | 12 | 31 | 14 | 27 |
| 35 | 15 | 21 | 28 | 33 |
| 20 | 01 | 34 | 26 | 06 |
| 32 | 10 | 19 | 18 | 22 |
| 16 | 17 | 23 | 13 | 29 |

Finish

FIG. 27

| Symbol | Multiplier | Probability |
|---|---|---|
| CHERRIES | 2 | 1 in 2 |
| STRAWBERRY | 3 | 1 in 4 |
| ORANGE | 4 | 1 in 8 |
| GRAPES | 5 | 1 in 16 |
| KEY | 10 | 1 in 16 |

| Matches | Prize* | 1/Probability |
|---|---|---|
| 4 | $10,000 | 129,670.1 |
| 3 | $100 | 1,573.4 |
| 2 | $10 | 56.1 |
| 1 | $2 | 4.9 |

| Prize | 1/Probability |
|---|---|
| $10,000 to $100,000 (avg. $14,861) | 129,670.1 |
| $100 to $1,000 (avg. $136) | 1,130.1 |
| $10 to $50 (avg. $14) | 43.6 |
| $4 to $8 (avg. $5) | 26.7 |
| $2 | 6.3 |
FIG. 35
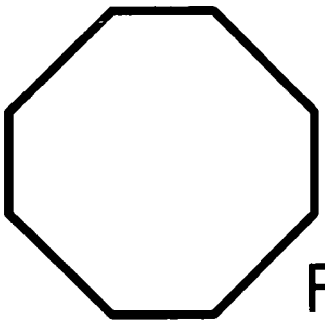
FIG. 36
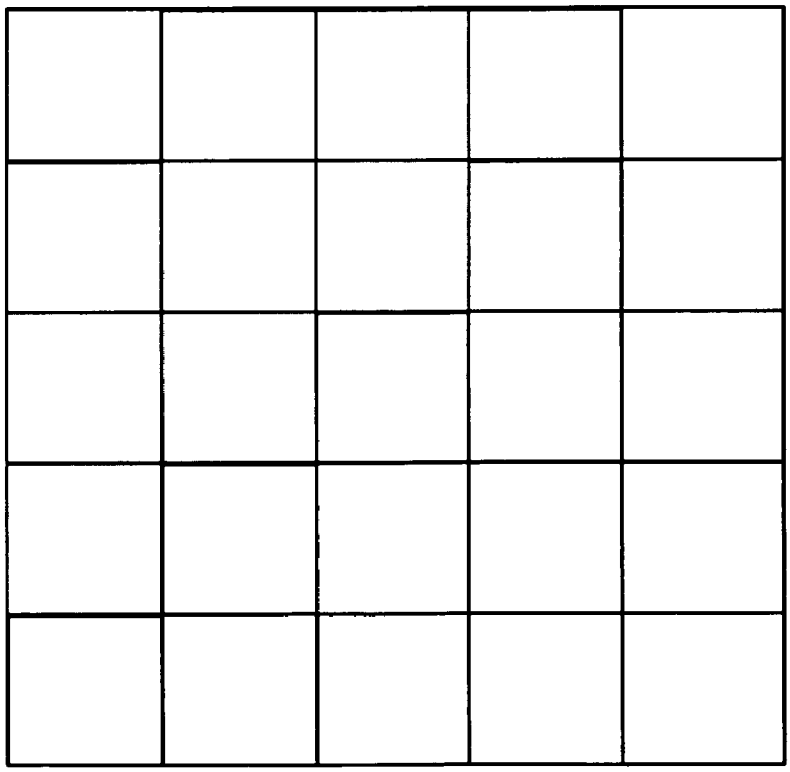
FIG. 37

| Matches | Prize | 1/Probability |
|---|---|---|
| 4 | $10,000 | 133,759.2 |
| 3 | $100 | 1,544.0 |
| 2 | $10 | 54.2 |
| 1 | $2 | 4.8 |

FIG. 40

| Prize | 1/Probability |
|---|---|
| $100,000 or more (avg. $157,197) | 4,185,120.1 |
| $50,000 to $99,999 (avg. $73,805) | 1,859,134.7 |
| $20,000 to $49,999 (avg. $29,423) | 370,295.6 |
| $500 to $19,999 (avg. $1,342) | 8,737.0 |
| $100 to $499 (avg. $174) | 502.8 |
| $50 to $99 (avg. $74) | 254.4 |
| $20 to $49 (avg. $30) | 51.7 |
| $7 to $19 (avg.$8) | 5.0 |

FIG. 41

| Matches | Prize | 1/Probability |
|---|---|---|
| 9 | $100,000 | 17,258,595.6 |
| 8 | $50,000 | 331,896.1 |
| 7 | $1,000 | 14,790.5 |
| 6 | $100 | 1,147.0 |
| 5 | $50 | 140.1 |
| 4 | $10 | 26.0 |
| 3 | $5 | 7.4 |

FIG. 43

LOTTERY GAME UTILIZING NOSTALGIC GAME THEMES

CROSS REFERENCE TO RELATED APPLICATION

This application claims the benefit of U.S. Provisional Application No. 60/642,242, Wagering Game Method, filed on Jan. 7, 2005, the entirety of which is hereby incorporated herein by this reference.

BACKGROUND OF THE INVENTION

1. Field of the Invention

The invention relates in general to lottery game methods. More particularly, the invention relates to an on-line lottery wagering game.

2. Description of the Related Art

Many lottery games are available for the public to purchase. However, often people do not play these games for two simple reasons: the games do not appeal to them and the rules for these games are too confusing.

Most people enjoy playing games, either computer games, electronic games, or board games at a younger age. People often have fond memories of the games they played as children and often they still remember the rules for these games. One of such popular games is Pac Man®, which was very popular in the 1980s. In this game, the player moves an icon through different paths on a grid and tries to capture as many cookies as possible while evading ghosts who are after the player's icon. The game was easy to learn and fun to play. Pac Man® has long been replaced by more advanced video games, but it still has a special place in people's memory.

Although Pac Man® was a popular game and easy to play, it ran on electronic gaming devices that have long been retired. Pac Man® is an excellent vehicle to bring people's nostalgic feeling. It is to such a lottery game that utilizes a nostalgic electronic game theme the present invention is primarily directed.

SUMMARY OF THE INVENTION

Briefly described, the present invention teaches a lottery game method where a player selects positions on a grid that form a pathway, whereupon the lottery authority randomly selects positions on the grid. Prizes and/or an entry into a lottery game are determined based on the intersection of the player's and the lottery authority's selections on the grid.

In one embodiment, there is provided a method of hosting a lottery game that includes selecting for a game player a plurality of game player positions on a predetermined grid, wherein the game player positions defining a pathway on the grid and the pathway being linear and continuous and composed of the selected game player positions, a lottery authority randomly selecting at least one position on the grid, and determining an outcome of the game based on the intersection of the pathway and the at least one position on the grid selected by the lottery authority.

In another embodiment, there is provided another lottery game that includes a plurality of game player selectable positions on a predetermined grid, wherein the game player positions defining a pathway on the grid and the pathway being linear and continuous, wherein the grid selectively populated with numbers and symbols from a lottery authority, and the outcome of the lottery game determinable based on the numbers and symbols in the pathway.

In yet another embodiment, there is provided another method for conducting a lottery game that includes receiving a path from a player, wherein the path being defined on a predetermined grid, placing a plurality of player indicia on the path, placing a plurality of symbols on a plurality of predetermined positions on the predetermined grid, determining a set of player indicia based on the plurality of player indicia on the path and the plurality of symbols on the grid, generating a set of winning indicia, comparing the set of player indicia and the set of winning indicia, and awarding a prize to the player based on comparison between the set of player indicia and the set of winning indicia.

In yet another embodiment, there is provided a method for hosting a lottery game. The lottery game method includes receiving a path from a player, wherein the path being defined on a predetermined grid, placing a plurality of symbols on a plurality of predetermined positions on the predetermined grid, and awarding a prize to the player if the path does not intercept with any of symbols placed on the predetermined grid.

In yet another embodiment, there is provided a system for hosting a lottery game. The system includes a communication network, at least one gaming machine in communication with the communication network, and a server in communication with the at least one gaming machine through the communication network. The server hosting the lottery game and being capable of receiving a path from a player, the path being defined on a predetermined grid, placing a plurality of player indicia on the path, placing a plurality of symbols on a plurality of predetermined positions on the predetermined grid, determining a set of player indicia based on the plurality of player indicia on the path and the plurality of symbols on the grid, generating a set of winning indicia, comparing the set of player indicia and the set of winning indicia, and awarding a prize to the player based on comparison between the set of player indicia and the set of winning indicia.

Other objects, features, and advantages of the present invention will become apparent after review of the Brief Description of the Drawings, Detailed Description of the Invention, and the Claims.

BRIEF DESCRIPTION OF THE DRAWINGS

FIG. 19 is an illustration of a prize table of the invention.

FIGS. 20-24 are illustrations of conditional probability tables for a draw-based game based on the outcome of the inventive game.

FIG. 25 is an illustration of a general probability table for game methods of the invention.

FIG. 27 is a schematic illustration of a game ticket with the player's selections indicated thereon.

FIG. 35 illustrates a sample composite prize table.

FIG. 36 illustrates one special symbol used in one embodiment of the invention.

FIG. 37 illustrates a select set of positions on a grid where the special symbol of FIG. 36 may be placed.

FIGS. 40-41 illustrate prizes tables according to one embodiment of the invention.

FIG. 43 illustrates another prize table according to the invention.

DETAILED DESCRIPTION OF THE INVENTION

The present invention is a method for a lottery game method where a player selects positions on a grid that form a pathway and the lottery authority randomly places a set of ghosts on the same grid. The interception of the pathway with any of ghosts determines a set of player indicia that will be compared with a set of winning indicia drawn by the lottery. Prizes are determined based on the number of matches between the player indicia and the winning numbers.

Referring now the drawings and presentation materials, let S be a set of positions on a grid. P, a subset of S, is a path if P is linear and continuous, i.e., it is visually apparent that P can be ordered in a progressive sequence from first to last: $P1<P2< \ldots <Pn$. Continuity means that if a and b $\in$P, elements of P, are adjacent in the order, they are adjacent geometrically. Less formally, there are no "breaks" in the path.

Figure 1:
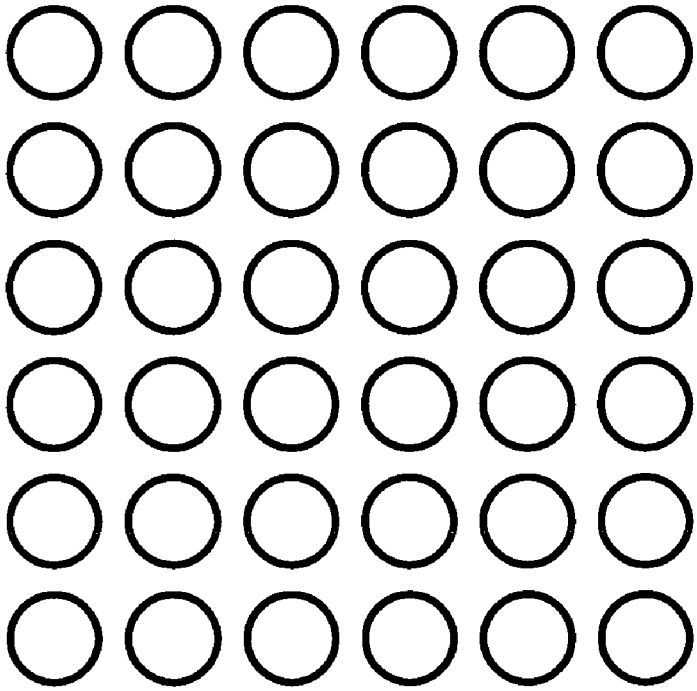
FIGS. 1-3 are schematic illustrations of a grid and of a pathway defined thereon.
Figure 2:
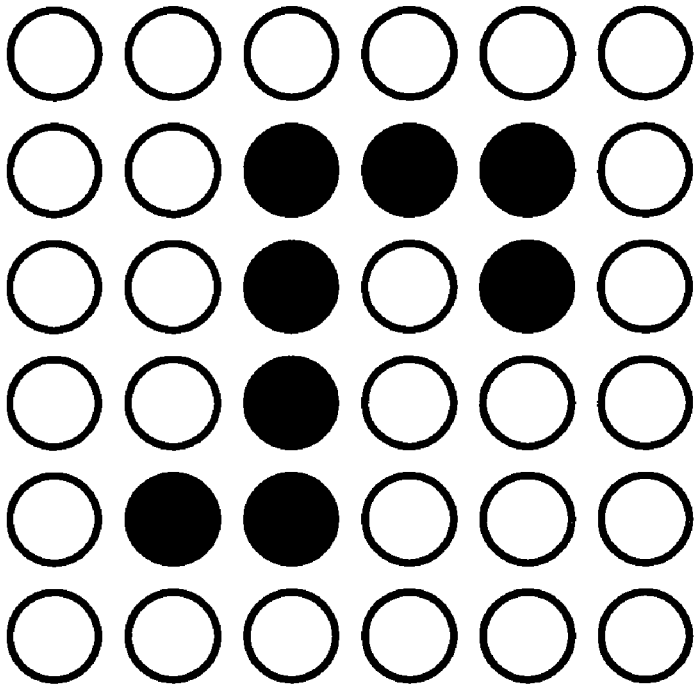
Figure 3:
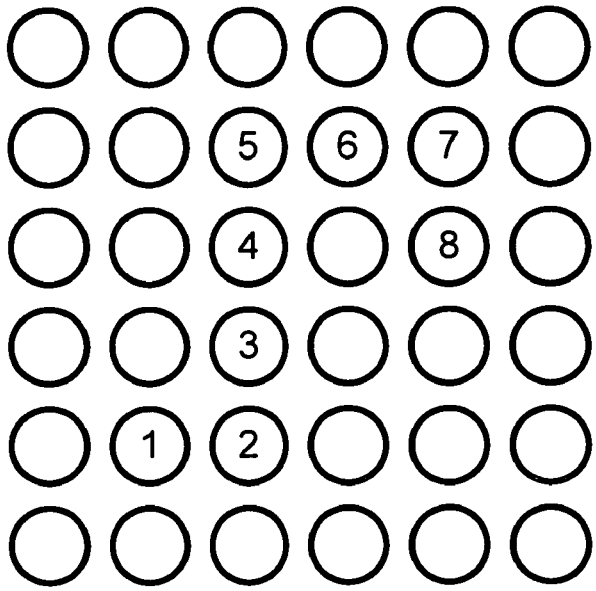

To demonstrate the concept of a path, consider a 6 by 6 grid with 36 positions indicated by small circles as shown in FIG. 1. In FIG. 2, eight of the positions have been selected (blackened) by a game player. The selection forms a path and suggests an order as indicated in FIG. 3, with the selected positions numbered from 1 to 8. This order is continuous as it is clear that if two positions are next to each other in the order, they are adjacent, i.e. one is immediately to the right or below the other.

In the current invention, a player's selection includes a path on a grid. The lottery authority selects positions on that grid as well. Prizes or an entry into a lottery game are based on the intersection of the player's path and the lottery authority's selection on the grid.

Figure 4:
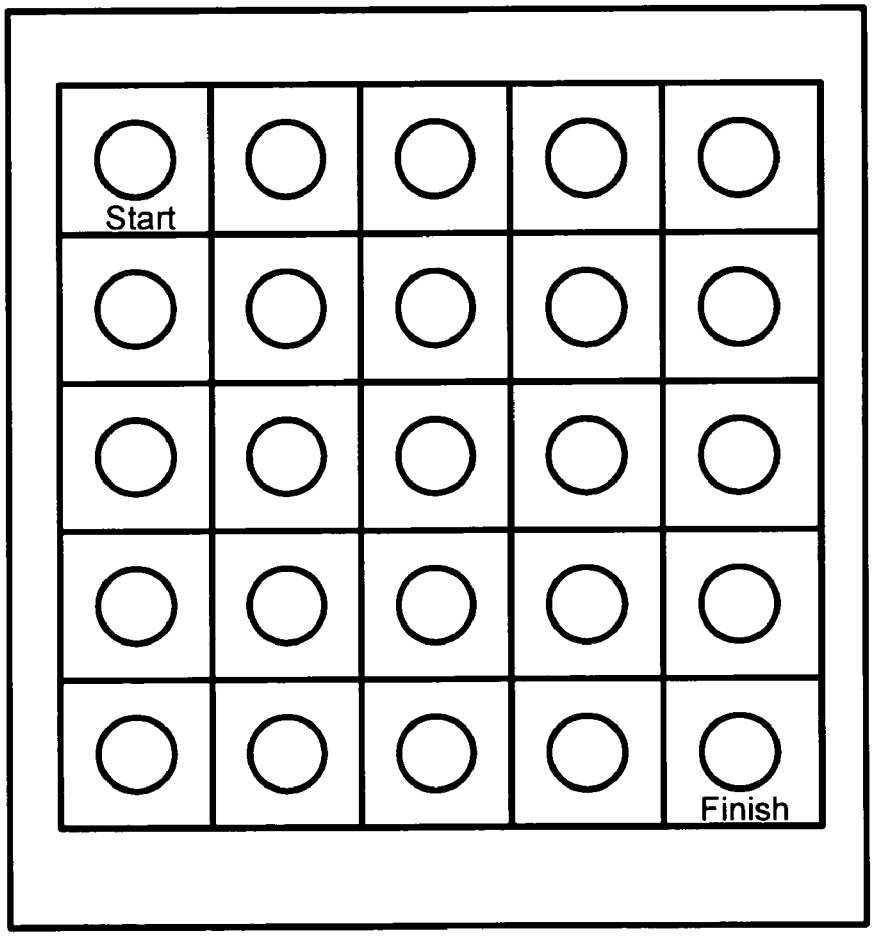
FIGS. 4-7 are illustrations of lottery game play slips.
Figure 5:
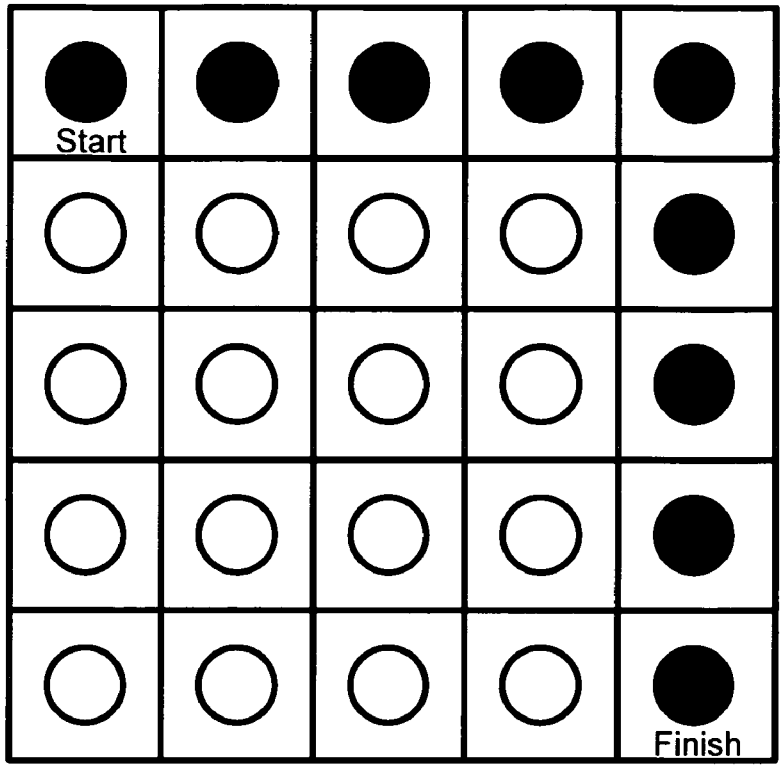
Figure 6:
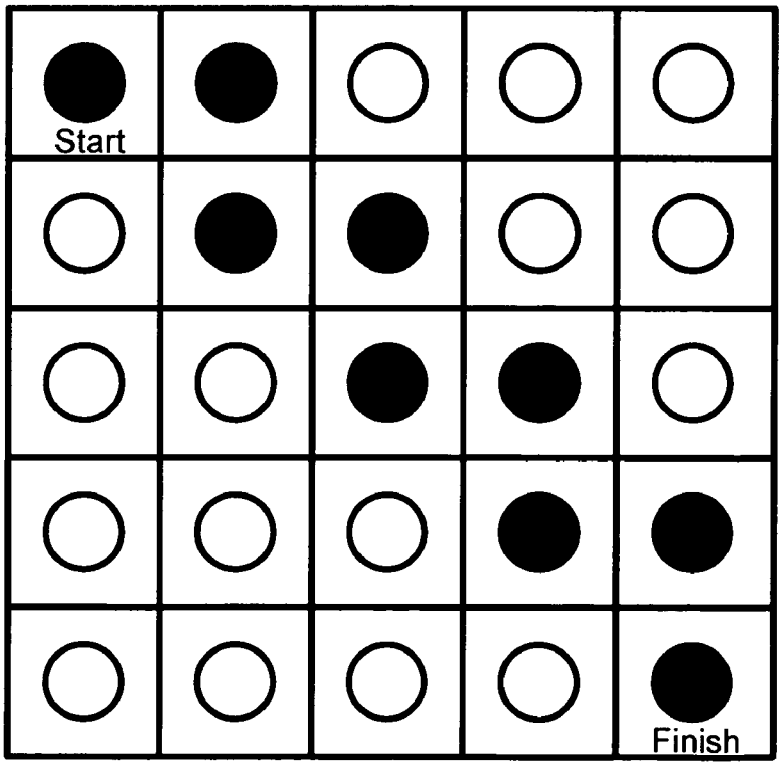
Figure 7:
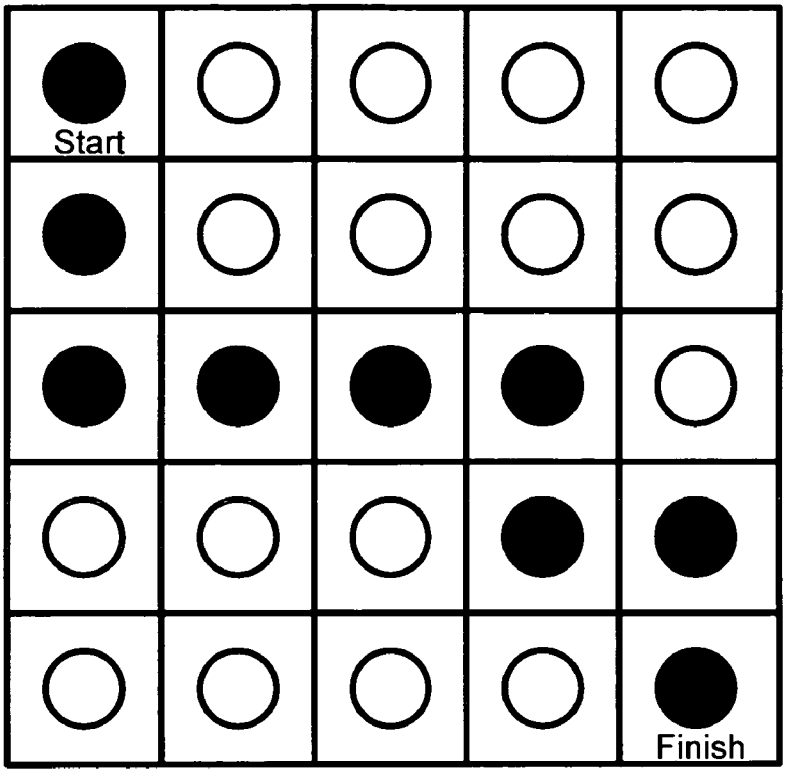

Referring now to FIGS. 4-8, the following embodiment is derived from the electronic game "Pac Man®") The player pays $2. FIG. 4 illustrates a play slip with a 5 by 5 grid of bubbles with one designated "Start" and one designated "Finish." The player selects a path of bubbles from "Start" to "Finish" by moving either down or to the right at each step. FIGS. 5-7 illustrate examples of possible player selections. The player thereafter receives a ticket memorializing their selection. For example, the ticket in FIG. 8 was generated by the play slip in FIG. 6.

The lottery authority randomly selects one position from each of 4 disjoint subsets of positions on a 5 by 5 grid. These subsets are illustrated in FIGS. 9-12, and are referred to as Subset 1, Subset 2, Subset 3, and Subset 4, respectively. For example, the positions in Subset 1, illustrated in FIG. 9, comprise the diagonal from the bottom left corner to the top right corner. Once the lottery positions have been selected, each is represented by a rendering of a "ghost," which is a character from the game of Pac Man®, as shown on FIG. 13. If none of the positions selected by the lottery authority intersect the player's path, the player wins $5, otherwise the player wins nothing.

Figure 8:
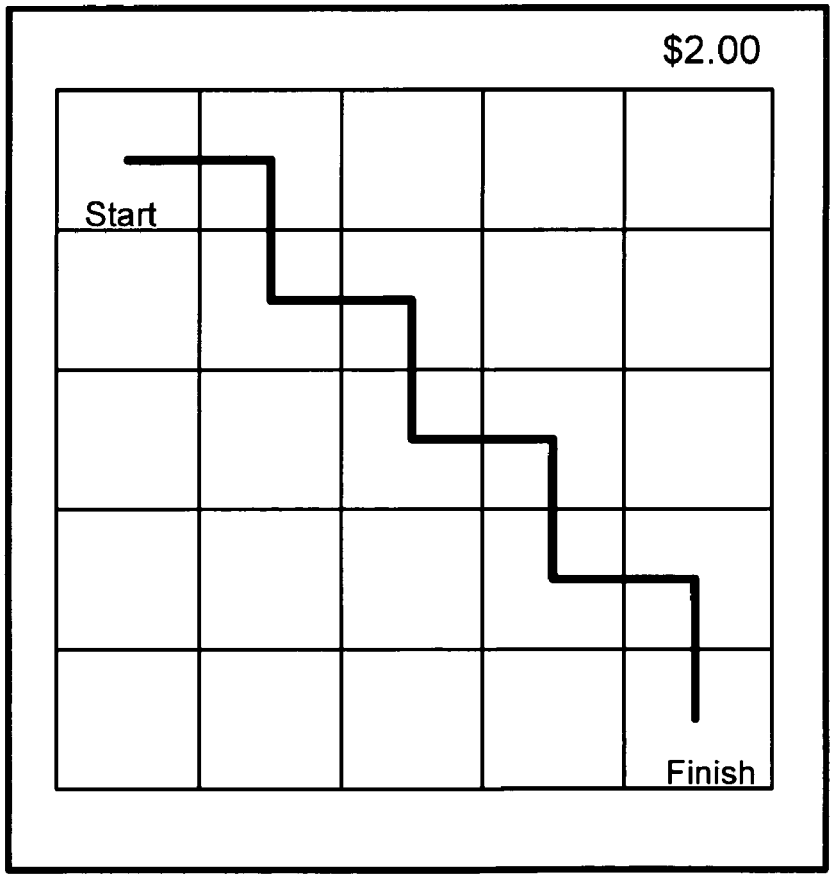
FIG. 8 is a schematic illustration a lottery game ticket of the invention.
Figure 9:
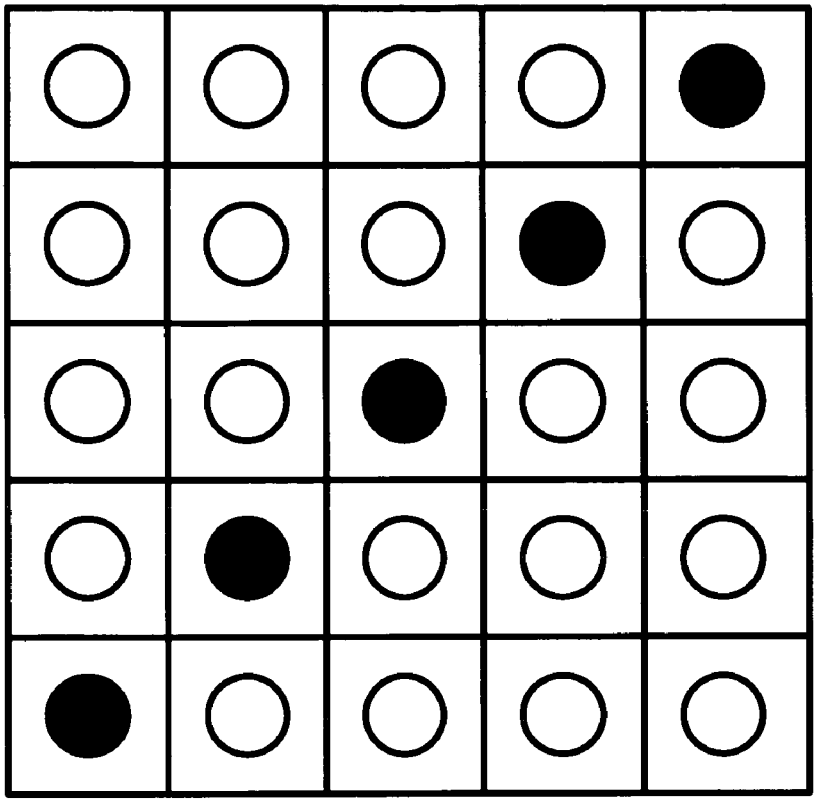
FIGS. 9-12 are schematic illustrations of subsets of possible lottery game selections for a game method of the invention.
Figure 10:
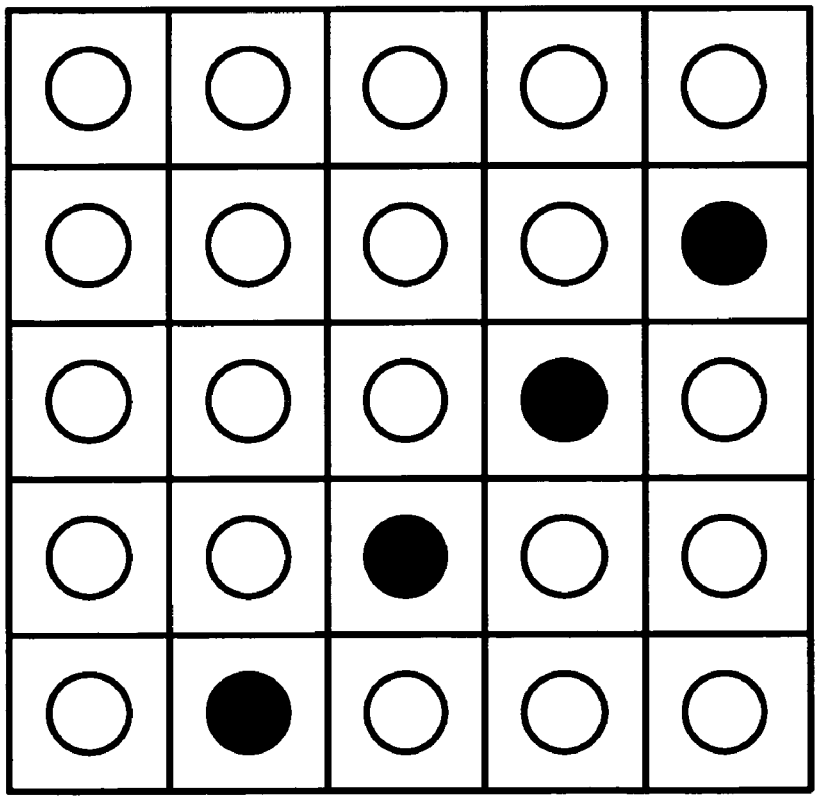
Figure 11:
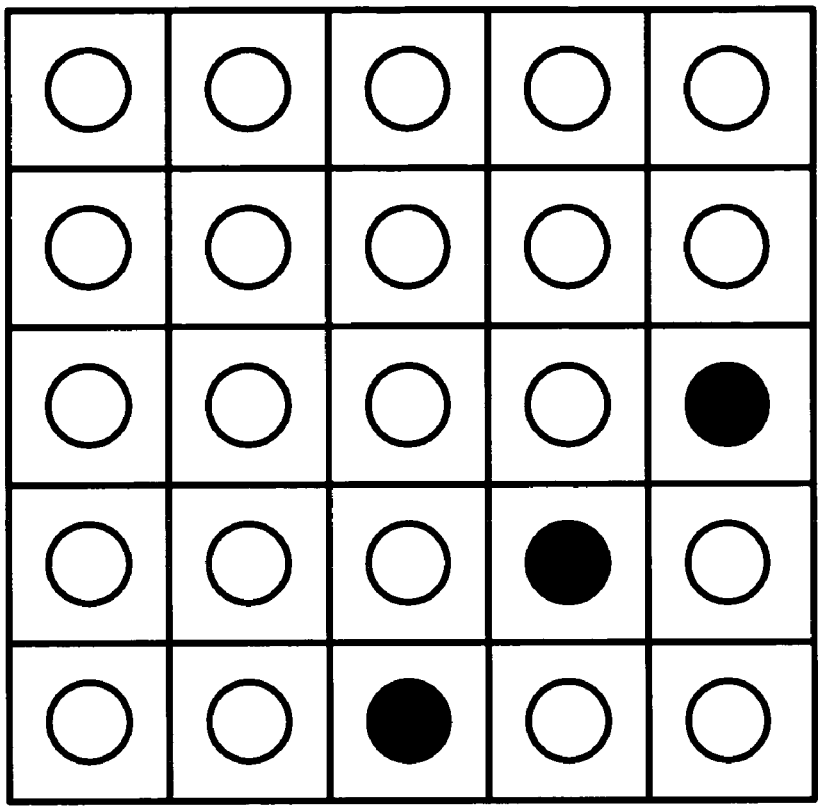
Figure 12:
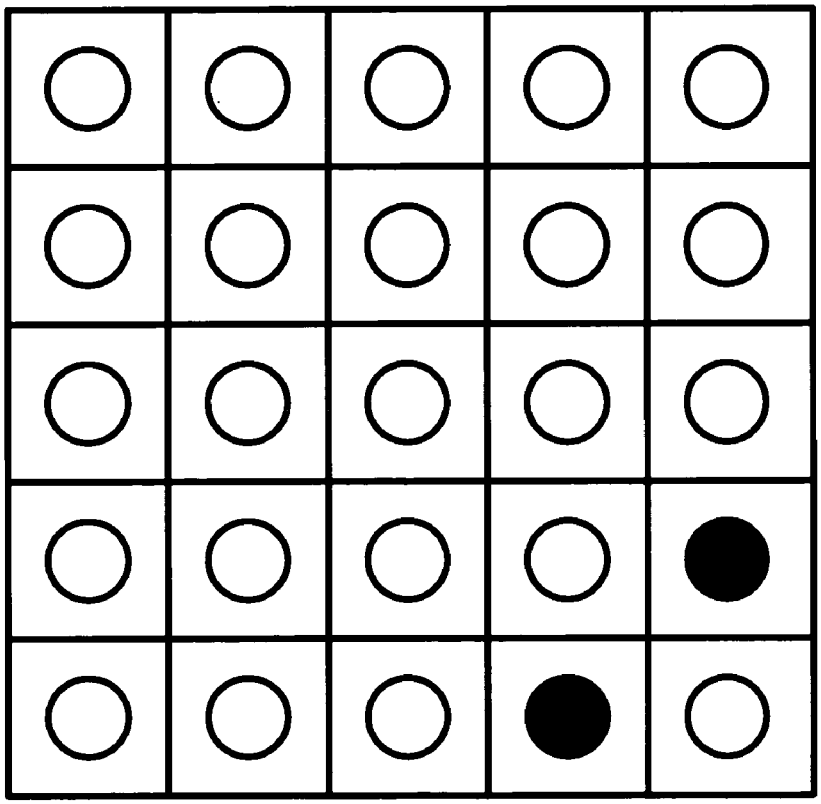
Figure 13:
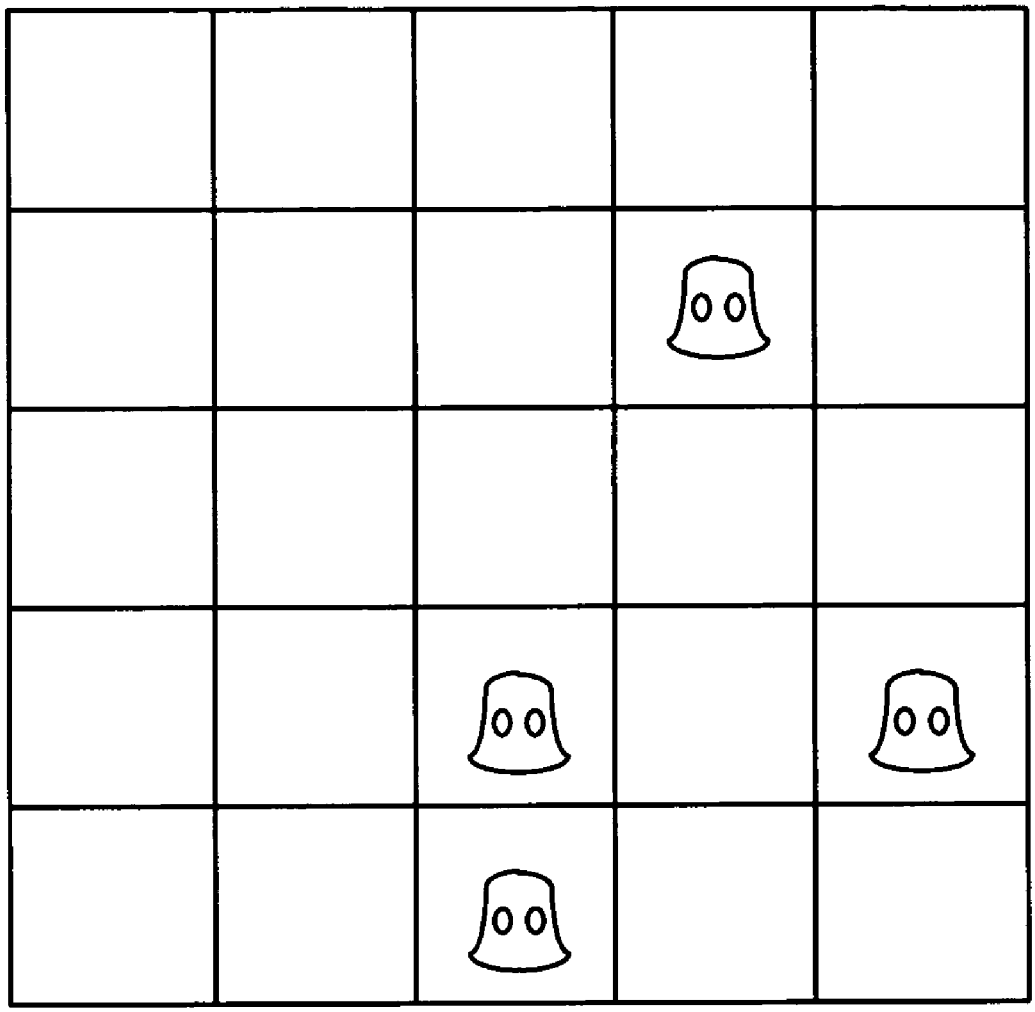
FIG. 13 is a schematic illustration of a lottery's game selections as publicly disclosed.

For example, suppose that FIG. 8 is a player's ticket. The draw consists of the lottery authority randomly selecting exactly one position from each of Subsets 1, 2, 3, and 4 in FIGS. 9-12. This draw is communicated by the image of 4 ghosts positioned on a grid as shown in FIG. 13. Such an image could be graphically or visually displayed on television, a monitor or in a newspaper, a cell phone, a handheld electronic device or as otherwise desired.

Figure 14:
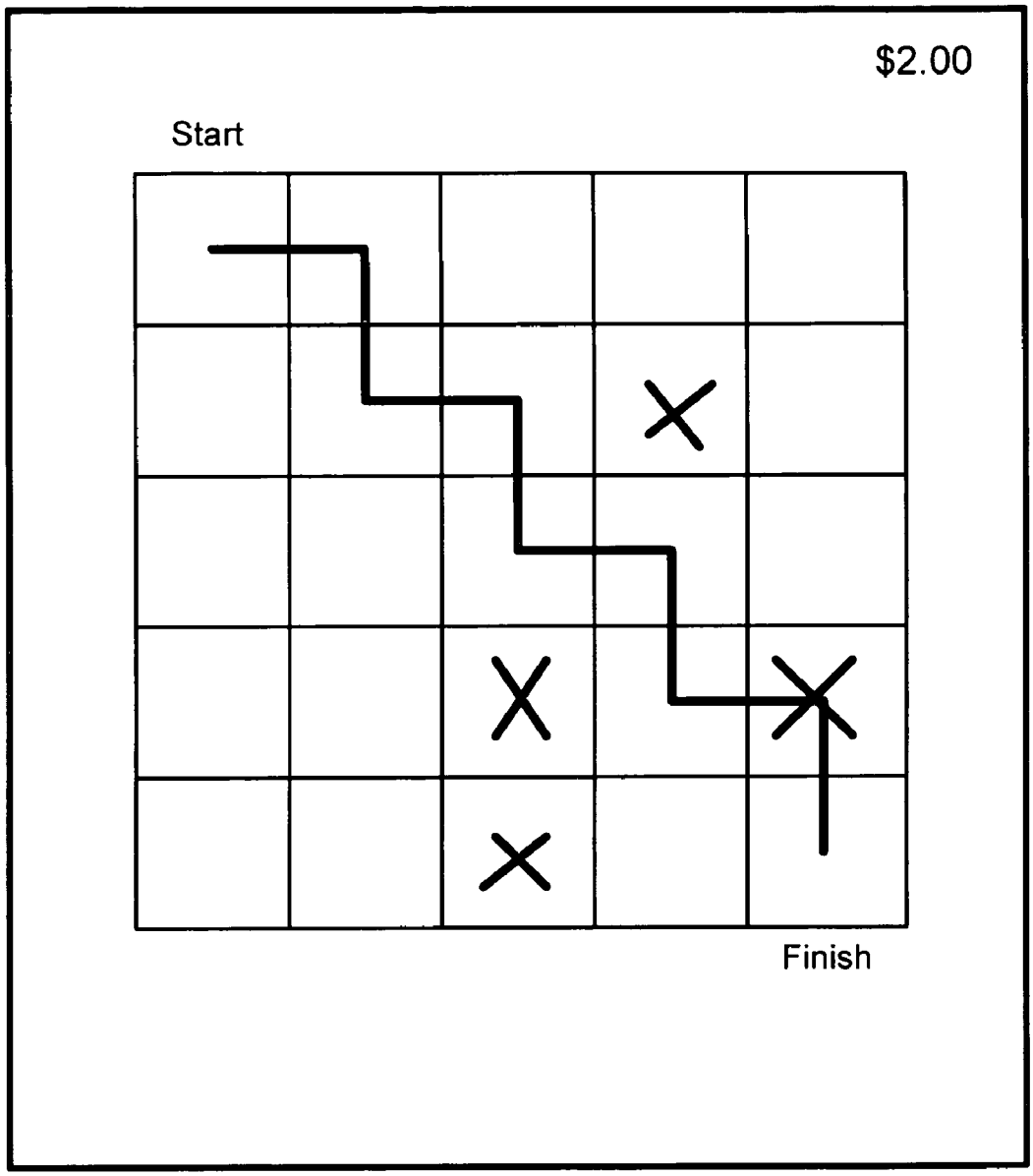
FIG. 14 is a schematic illustration of a lottery game ticket of the invention with the player's selections indicated thereon, and with the lottery's selections manually superimposed thereon.
Figure 15:
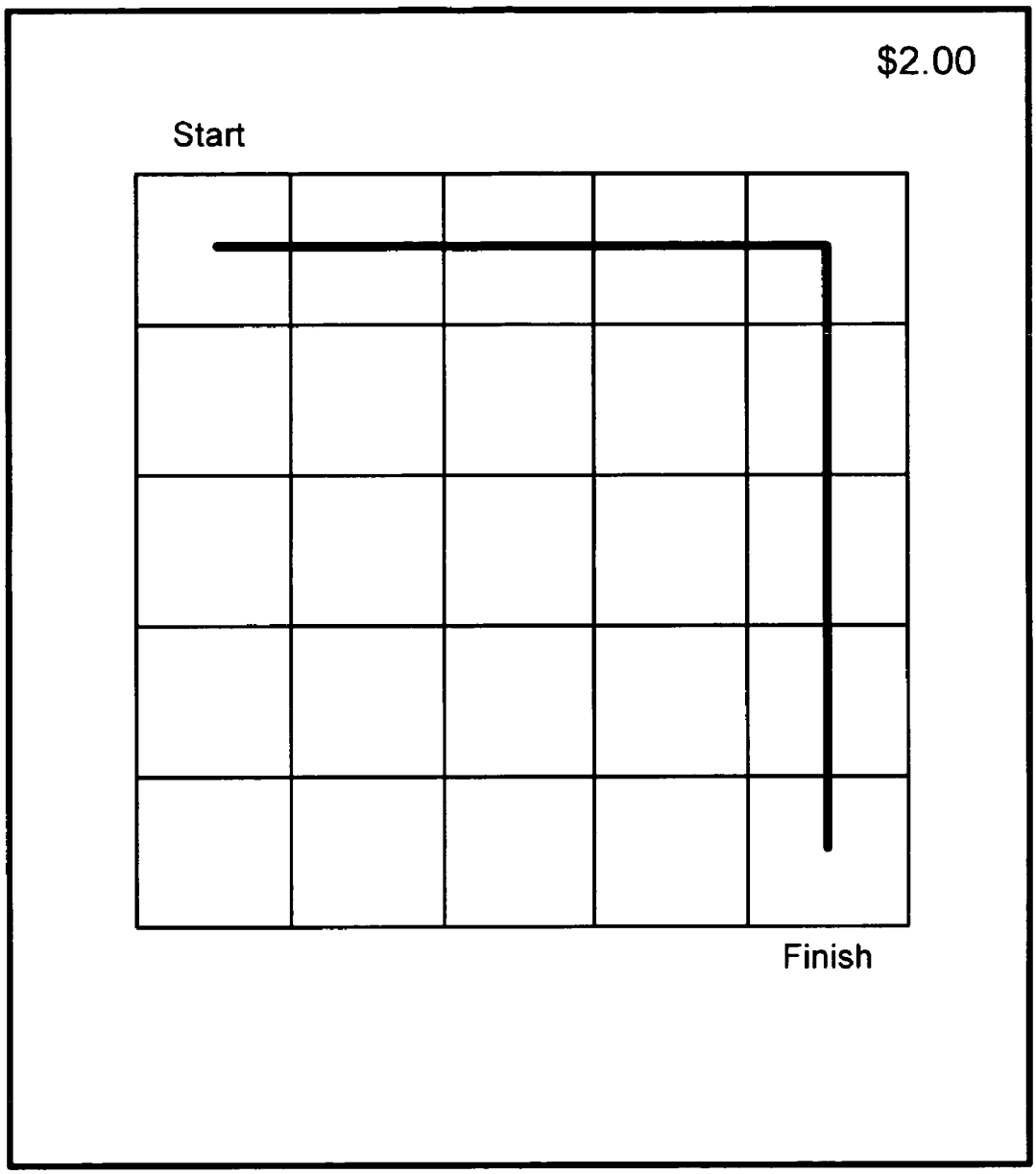
FIG. 15 is a schematic illustration a lottery game ticket of the invention.
Figure 16:
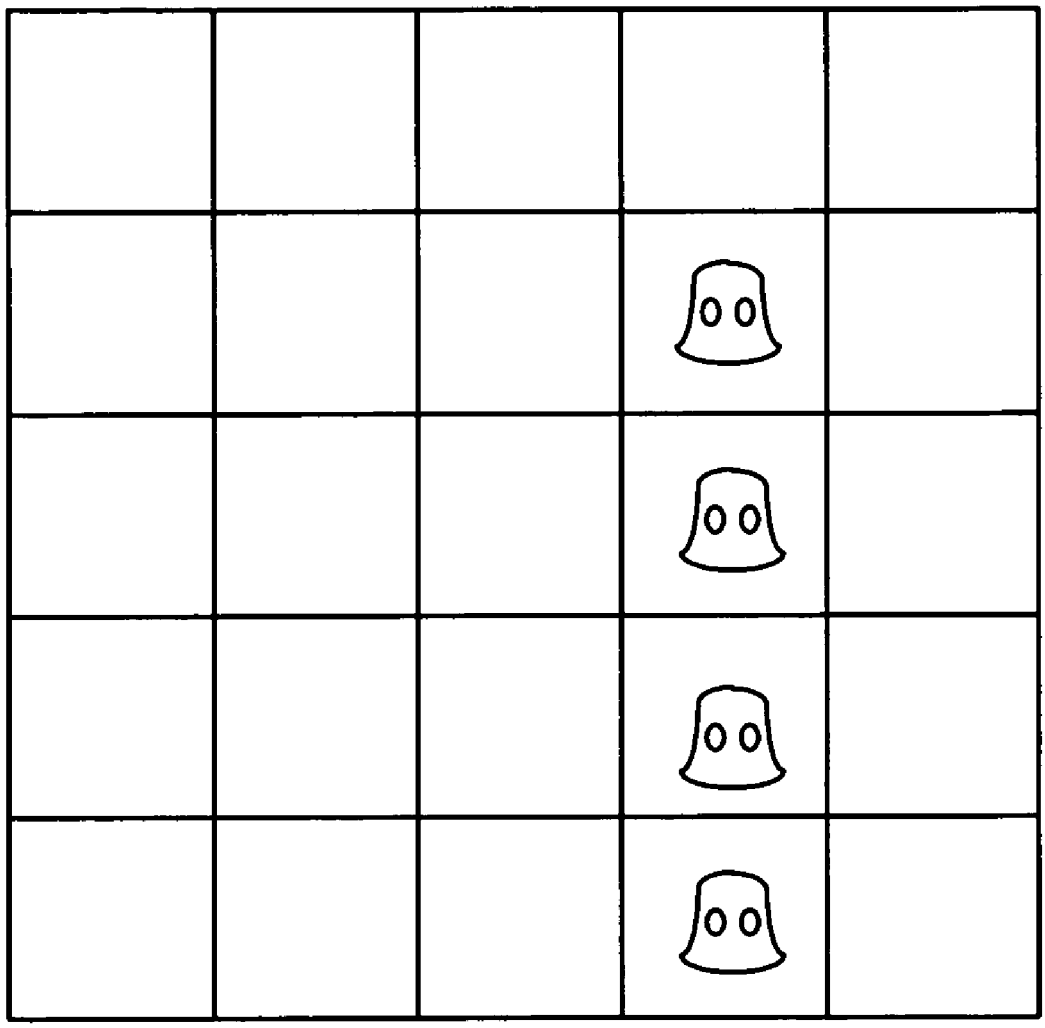
FIG. 16 is a schematic illustration of a lottery's selections as publicly disclosed.
Figure 17:
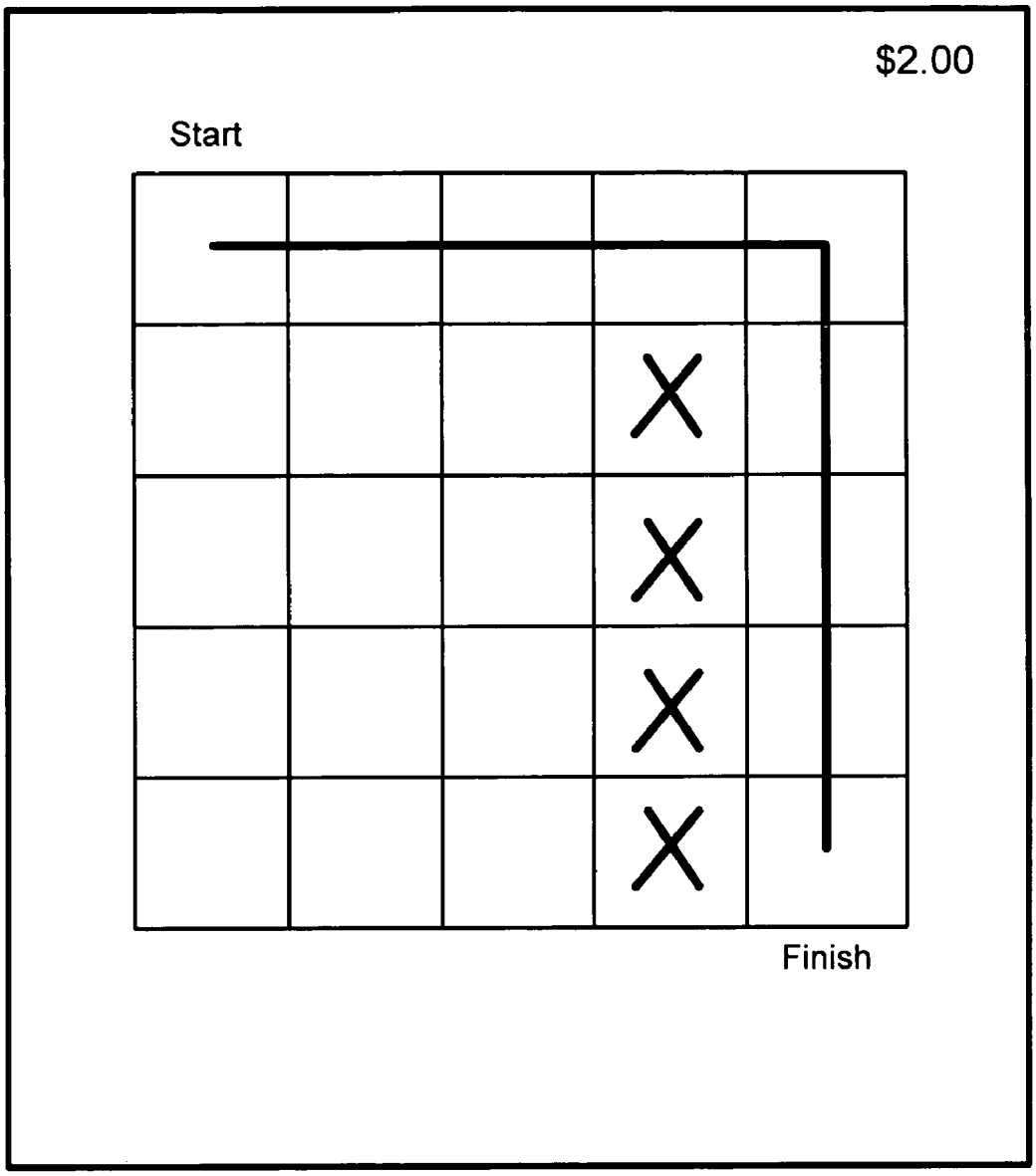
FIG. 17 is a schematic illustration of a lottery game ticket of the invention with the player's selections indicated thereon, and with the lottery's selections superimposed thereon.

The player marks the drawn positions on his ticket as shown in FIG. 14, such as with X's. As the lottery authority has drawn the position of the $4^{th}$ row down and $5^{th}$ column from the left and this is also one of the positions in the player's path, the player does not win. Consider now the ticket in FIG. 15 and the lottery authority's draw is represented in FIG. 16. The player marks the drawn positions on his ticket in FIG. 17. As none of these positions intersect his selection, he wins $5. It is easy to verify that the return for this game is 50% by the formula (probability×prize)/price=return. Note that the player's path intersects each of Subsets 1-4 exactly once. As exactly one ghost is chosen from each of these subsets, it is a straightforward calculation that the probability that a ghost does not intersect a player's path is $1-(\frac{4}{5}\times\frac{3}{4}\times\frac{2}{3}\times\frac{1}{2})=\frac{1}{5}$. Therefore, the return is $(\frac{1}{5}\times\$5)/\$2=50\%$.

In the following embodiment, the outcome of the inventive game defines an entry into a lottery game. A representative play slip for this embodiment is that in FIG. 4, (the same as in the above embodiment). The player selects a path of bubbles from "Start" to "Finish" by moving either down or to the right at each step, as in the above embodiment. FIGS. 5-7 illustrate various player selections. The player pays $2 and submits a play slip (or requests a quick-pick). The lottery authority draws positions at the time of the purchase and these positions are represented on the ticket as ghosts.

Figure 18:
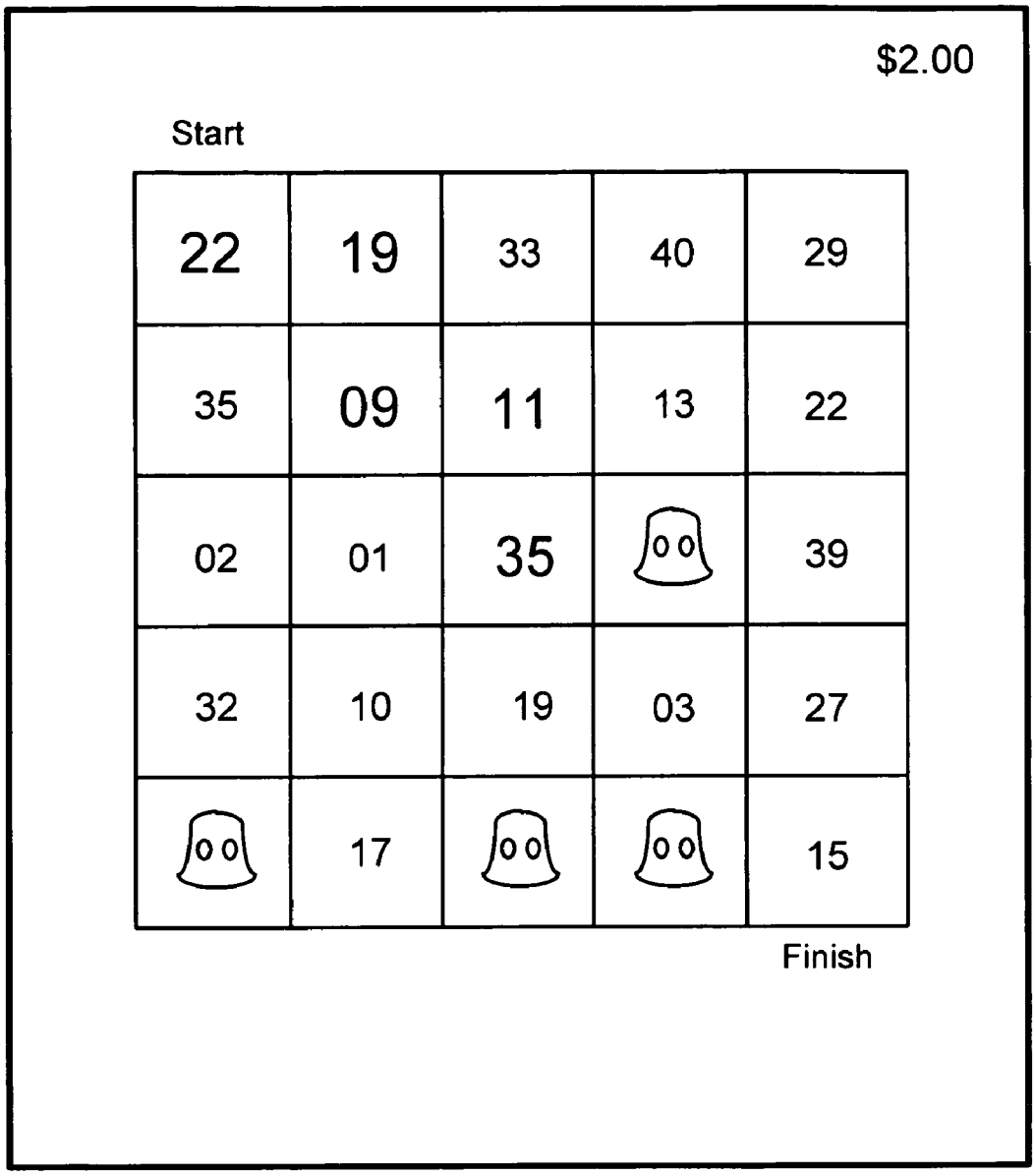
FIG. 18 is a schematic illustration of a game ticket with the both the player's and the lottery's selections indicated thereon.

For example, suppose the player submits the play slip in FIG. 6. He may receive a ticket as shown in FIG. 18. The grid on his ticket is occupied by 21 distinct numbers out of 1 to 40 and 4 ghosts. The positions of the ghosts are randomly selected by the lottery authority from each of Subsets 14 (FIGS. 9-12). The numbers in the path the player selected are highlighted from the "Start" position up to the position immediately before his path encounters a ghost. The ghost acts as a delimiter and stops the path. If there are no ghosts in the player's chosen path, all of the numbers in the path are highlighted. These highlighted numbers comprise an entry into a draw-based lottery game.

The lottery authority subsequently draws 4 numbers from 1 to 40 as an event, for example as a "daily draw." Prizes are based on the number of matches between the lottery authority's draw and the player's entry. For example, suppose the player's ticket is that in FIG. 18. There are 5 highlighted numbers before his path encounters a ghost at the $6^{th}$ step of his path. His entry comprises the numbers in his path before the ghost: 22-19-09-11-35. The lottery authority subsequently draws 03-19-21-22. As the player matches the numbers 19 and 22 he is credited with 2 matches. He is awarded $5 as indicated by the prize table in FIG. 19.

Figure 26:
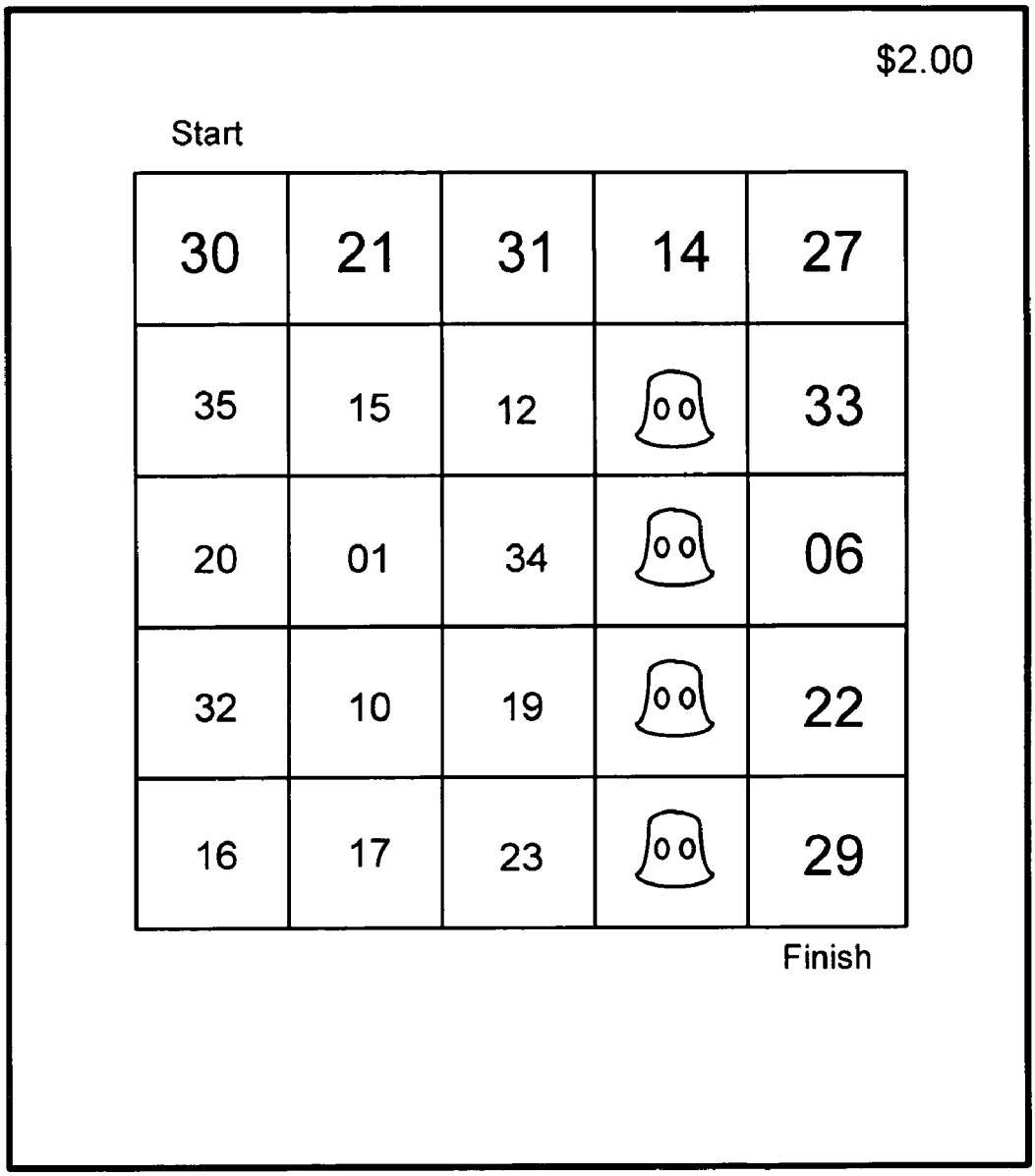
FIG. 26 is a schematic illustration of a game ticket with the both the player's and the lottery's selections indicated thereon.

As another example, suppose that the play slip is as in FIG. 5 and the player's ticket is that of FIG. 26. As none of the drawn ghosts intersect the player's path his entry comprises 9 numbers: 30, 21, 31,14, 27, 33, 06, 22, and 29. The lottery authority draws 21, 27, 29, and 39. As the player's entry includes 21, 27, 29 he has three matches and is awarded $50 as indicated by the prize table for this game in FIG. 19. It is to the player's advantage for his path to encounter a ghost later, or not at all, rather than earlier in his path as this allows for more numbers in his entry and thus a greater chance to match the lottery authority's draw.

The prize table for the embodiment of the game described above is illustrated in FIG. 19, and to derive this prize table it is necessary to compute the probabilities for the various number of matches. There are 5 different cases for how the drawn positions can intersect the player's path. In case 1, the lottery authority's selection from subset 1 (FIG. 9) is the first lottery-selected position to intersect the player's path. In case 2, subset 2 (FIG. 10) is the first; in case 3, subset 3 (FIG. 11) is the first; in case 4, Subset 4 (FIG. 12) is the first; and in case 5, the lottery authority's selected positions do not intersect the player's path. Note that regardless of how the player selects a path, the path intersects each of subsets 14 (FIGS. 9-12) exactly once. Moreover, the player's path intersects subsets 14 (FIGS. 9-12) in that order. The path intersects Subset 1 at the $5^{th}$ step of his path, Subset 2 at the $6^{th}$ step of his path, and so on.

It is easily verified that the probability of each case occurring is ⅕. For example, case 1 occurs if and only if the ghost randomly selected from subset 1 (FIG. 9) is in the player's selected path. As there are 5 positions, the lottery authority has a ⅕ chance of choosing the position that intersects the player's path. For case 2 to occur, it must be the case that the lottery authority's selection from subset 1 (FIG. 9) does not intersect the player's path but the lottery authority's selection from subset 2 (FIG. 10) does. As there are 5 positions in subset 1 (FIG. 9) and 4 positions in subset 2 (FIG. 10), this probability is $\frac{4}{5}\times\frac{1}{4}=\frac{1}{5}$. Similarly, the probability for case 3 is $\frac{4}{5}\times\frac{3}{4}\times\frac{1}{3}=\frac{1}{5}$ and the probability for case 4 is $\frac{4}{5}\times\frac{3}{4}\times\frac{2}{3}\times\frac{1}{2}=\frac{1}{5}$. Case 5 is the complement of cases 14, which is $1-(4\times\frac{1}{5})=\frac{1}{5}$. Which of these cases occurs determines how many numbers are in the player's entry.

Case 1 results in 4 numbers being in the player's entry. For case 2, there are 5 numbers in the player's entry. For case 3, there are 6 numbers in the player's entry. For case 4, there are 7 numbers in the player's entry. For case 5, there are 9 numbers in the player's entry. Furthermore, given one of these cases, the probability for the number of matches can be computed using the hypergeometric probability distribution. Probability tables given each of these cases are illustrated in FIGS. 20-24. For example, given that there are 5 numbers in the player's entry the probability that the player will match 2 is that indicated in FIG. 21: 0.0651055914 (rounded to the nearest $10^{10}$). A general probability table for this game, FIG. 25, is derived by weighting each of the tables by ⅕ and adding the corresponding probabilities together. For example, the probability of matching 2 is:

$$\tfrac{1}{5}\times0.0413611993+\tfrac{1}{5}\times0.0651055914+\tfrac{1}{5}\times0.0920779079+\tfrac{1}{5}\times0.1213261845+\tfrac{1}{5}\times0.1831710253=0.1006083817$$

The prize table in FIG. 19 is based on these probabilities. Those skilled in the art of mathematics can confirm that such a prize structure returns 64.1% based on a $2 price point.

A variation on this embodiment is to have the ghosts drawn and the lottery numbers drawn as events separate from the ticket. For example, suppose that a player's play slip is as shown in FIG. 6 and they receive a ticket as shown in FIG. 27. The ticket comprises 25 numbers out of 1 to 40 identified with the 25 positions of the grid. The numbers in the path selected by the player is also indicated. In this case, the font for the numbers on the player's path is larger than that for the others to distinguish them.

Figure 28:
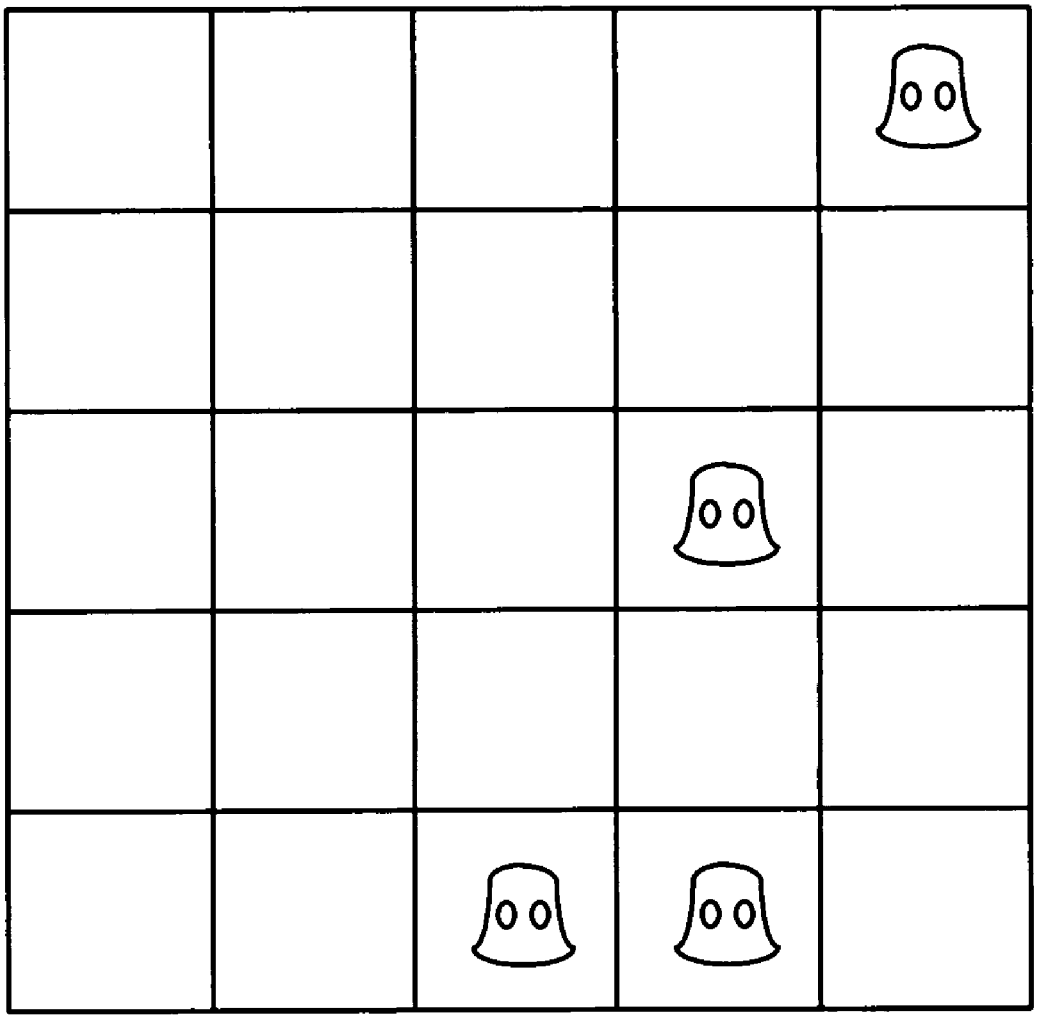
FIG. 28 is a schematic illustration of a game ticket with the lottery's selections as publicly disclosed.
Figure 29:
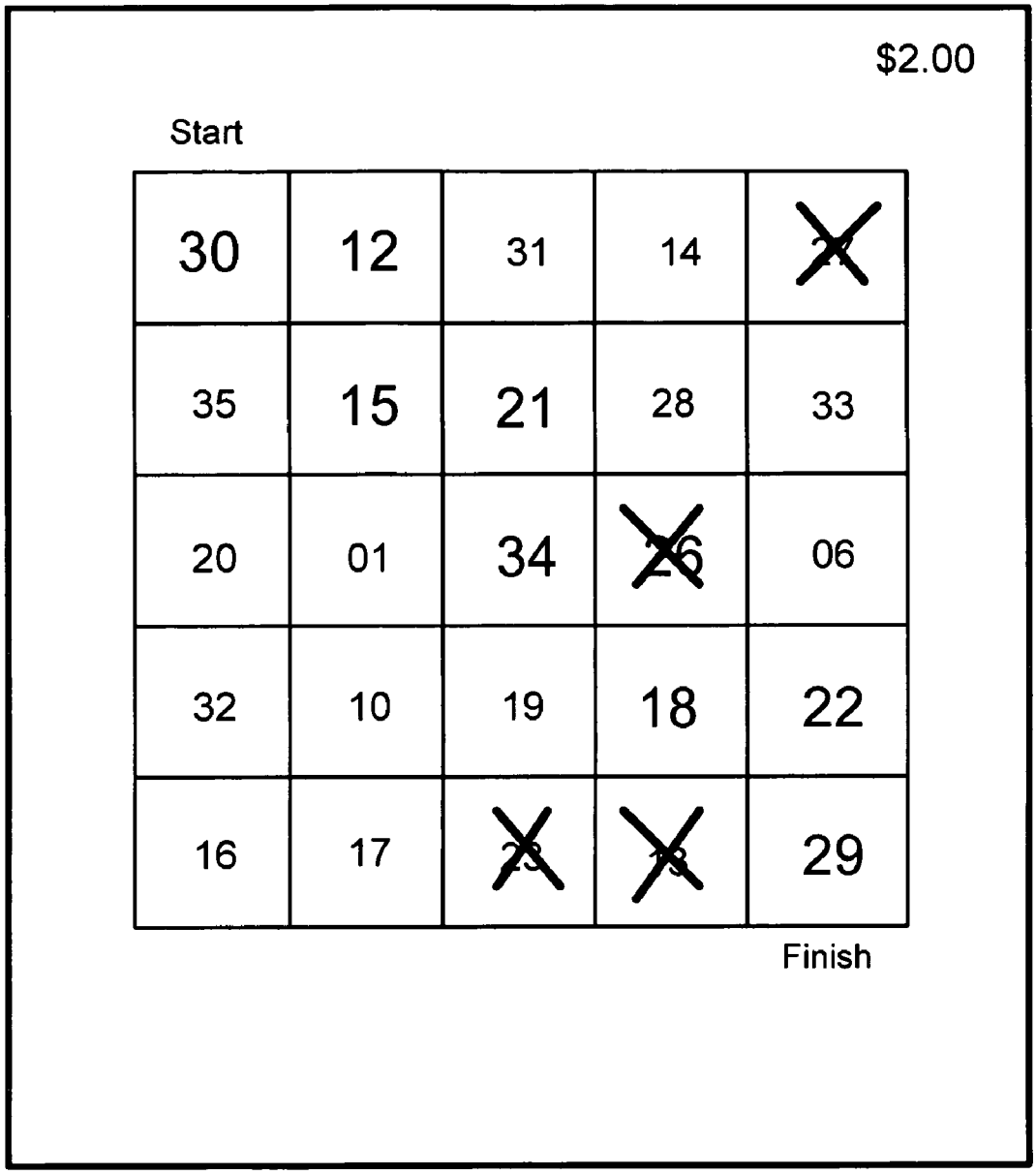
FIG. 29 is a schematic illustration of the game tickets of FIG. 27-28, with the player's selections indicated thereon, and with the lottery's game selections manually superimposed thereon.

The lottery authority subsequently draws 4 ghosts and 4 numbers from 1 to 40. The lottery authority randomly draws the four ghosts one at a time from subsets 14 (FIGS. 9-12). The drawn ghosts are displayed on a grid as that in FIG. 28. Such a draw could be publicly disclosed in a variety of ways such as by television or by the newspaper. The player then identifies the positions of the drawn ghosts on his ticket. In FIG. 29 he has marked these positions with X's. The first position in the path for which there is an X is that of the $3^{rd}$ row down $4^{th}$ column from the left. His entry comprises the numbers in his path up to but not including that point: 30, 12,15, 21, and 34. The lottery authority draws 15, 18, 21, and 35. The player is credited with matching 15 and 21. He is not credited with matching 18 even though 18 is one of the numbers on his path. This is because 18 occurs after a ghost is encountered. He receives $5 for matching 2 as indicated on the prize table in FIG. 19.

Figure 30:
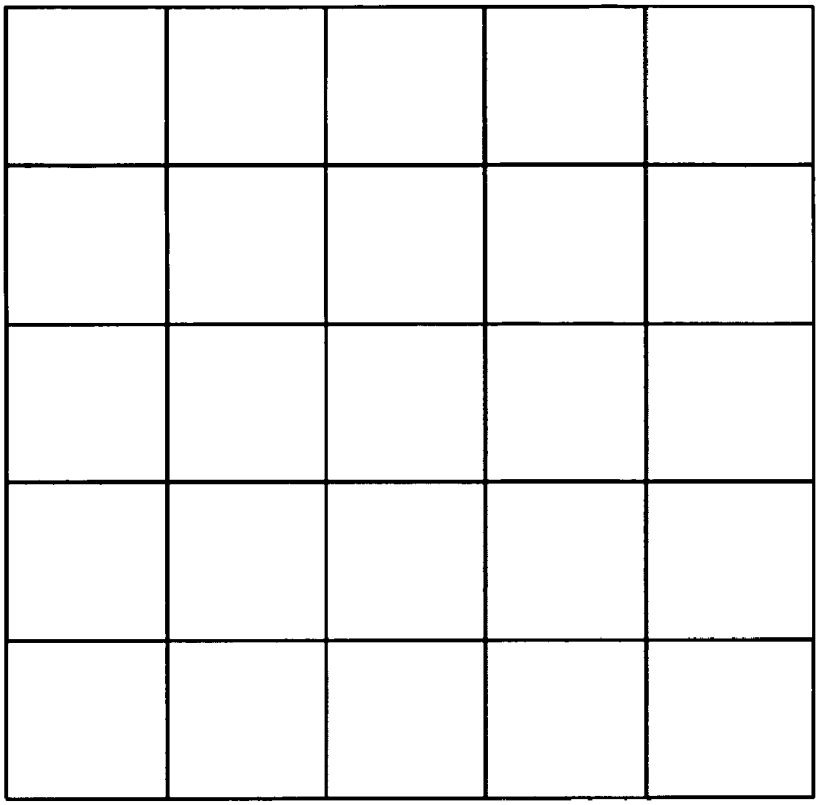
FIG. 30 illustrates a select set of positions on a grid where ghosts may be placed.
Figure 31:
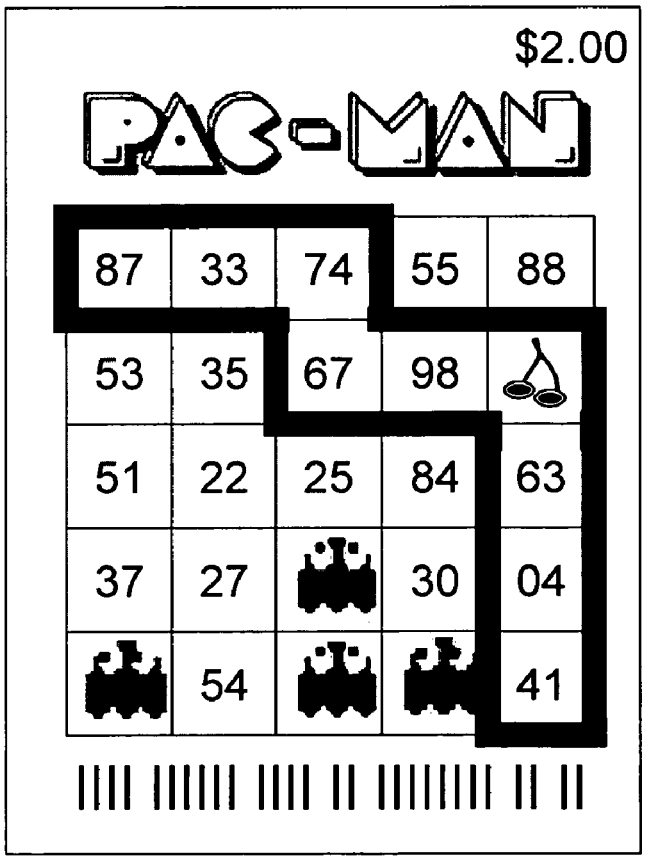
FIG. 31 illustrates an exemplary ticket according to one embodiment of the invention.

In other embodiments, the current invention incorporates symbols that affect the game mechanics and/or prizes. A player "wins" a symbol depending on whether or not and at what point the symbol occurs in the selected path on his ticket. One example is a symbol that awards a multiplier that is applied to the player's winnings. In one embodiment, the player purchases a ticket for $2.00. A 5 by 5 grid is populated with distinct numbers ranging from 00 to 99 (100 numbers) and four ghosts. The ghosts are randomly placed along the diagonals in FIGS. 9-12 as described in earlier embodiments. There is also a symbol, which is identified with a multiplier, placed in one of the 14 shaded cells in FIG. 30, after the 4 ghosts have been placed, i.e., in one of the 10 remaining cells. FIG. 31 illustrates an example of such a ticket.

Figures 32, 33, 34:
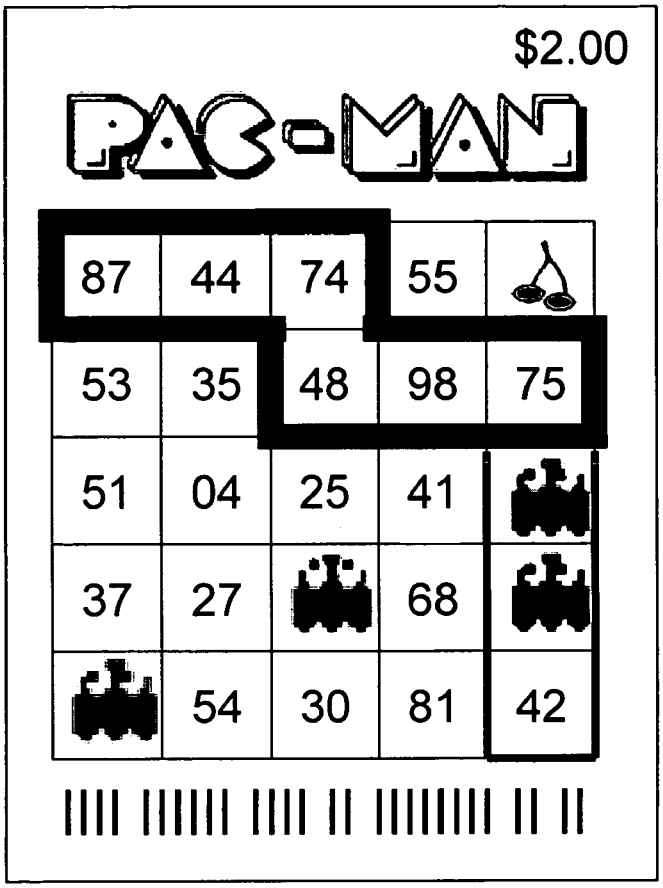
FIG. 32 illustrates another exemplary ticket according to one embodiment of the invention.
FIG. 33 illustrates a sample multiplier table.
FIG. 34 illustrates a sample prize table.

There may be several different symbols that can be placed on the grid and each symbol has a different multiplier value. FIG. 33 illustrates an example of different symbols, and their respective multiplier values and probabilities. For example, a ticket has a probability of 50% of having a CHERRIES placed on the ticket. The player selects a path. His numbers comprise those in the path prior to being obstructed by a ghost. Prizes are based on the number of matches between his numbers and those drawn by the lottery. If it is the case that the symbol occurs in the player's selected path before a ghost, then the associated multiplier is applied to his winnings. If a CHER- RIES symbol occurs in the player's selected path before a ghost is encountered, the player wins a 2 multiplier. In FIG. 32, the CHERRIES symbol is assigned the position of $1^{st}$ row, $5^{th}$ column. However, the symbol does not occur in the player's selected path. The player does not win the multiplier.

FIG. 34 illustrates the base prize table for this embodiment, i.e., prizes based on the number of matches between the player's and the lottery authority's drawn numbers. This prize will subsequently have a multiplier applied if the player wins a symbol. For example, if the draw is 41, 47, 68, 87, then the ticket in FIG. 31 has 2 matches (41 and 87). By the prize table in FIG. 34, the ticket is awarded $10. Also, as he has won a CHERRIES symbol the player gets a 2 multiplier. The final prize is 2×$10=$20. Those skilled in the art of Mathematics can verify that the above described embodiment pays out 53.3%. FIG. 35 illustrates a composite prize table for the above embodiment.

In another embodiment, a "Power Pill" symbol, FIG. 36, is incorporated into the game. This embodiment costs $5.00 per ticket. This embodiment is similar to that previously described. On the ticket, a 5 by 5 grid is similarly populated with numbers (00 to 99), ghosts and symbol, which has an associated multiplier. In addition, a Power Pill symbol is randomly placed in one of the 9 shaded cells in FIG. 37. In this embodiment, the Power Pill is worth a 2 multiplier and confers immunity to the ghosts, i.e., if the player wins the Power Pill, then his path cannot be obstructed by a ghost. The Power Pill acts like a ghost remover or a path delimiter remover. Instead, the player wins the ghosts that occur in his path, which are worth multipliers.

Figure 38:
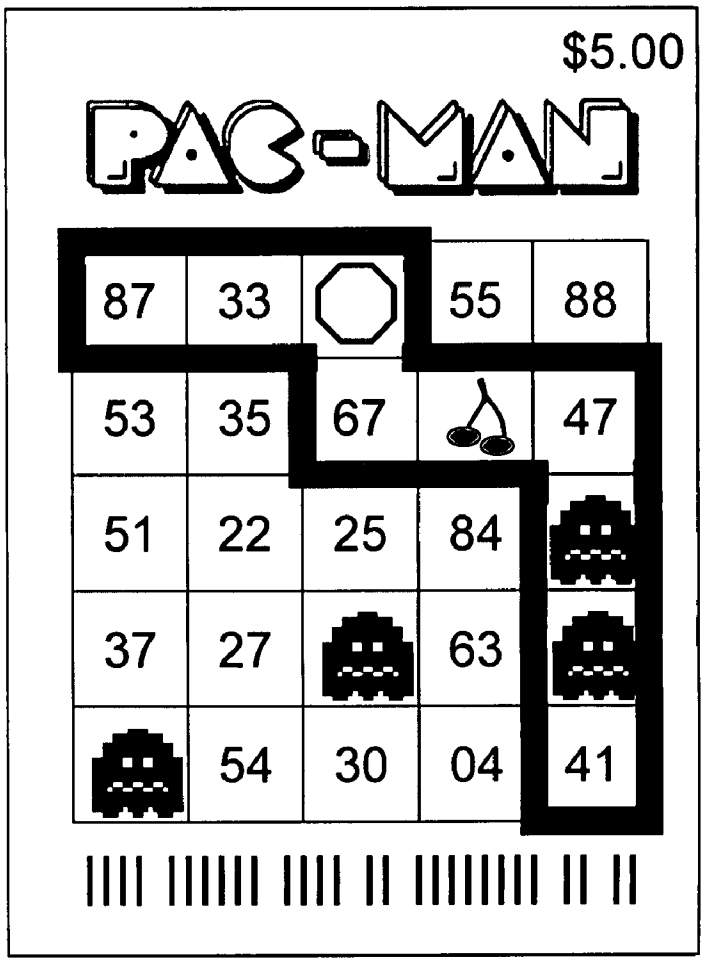
FIGS. 38-39 illustrate sample tickets according to one embodiment of the invention.
Figure 39:
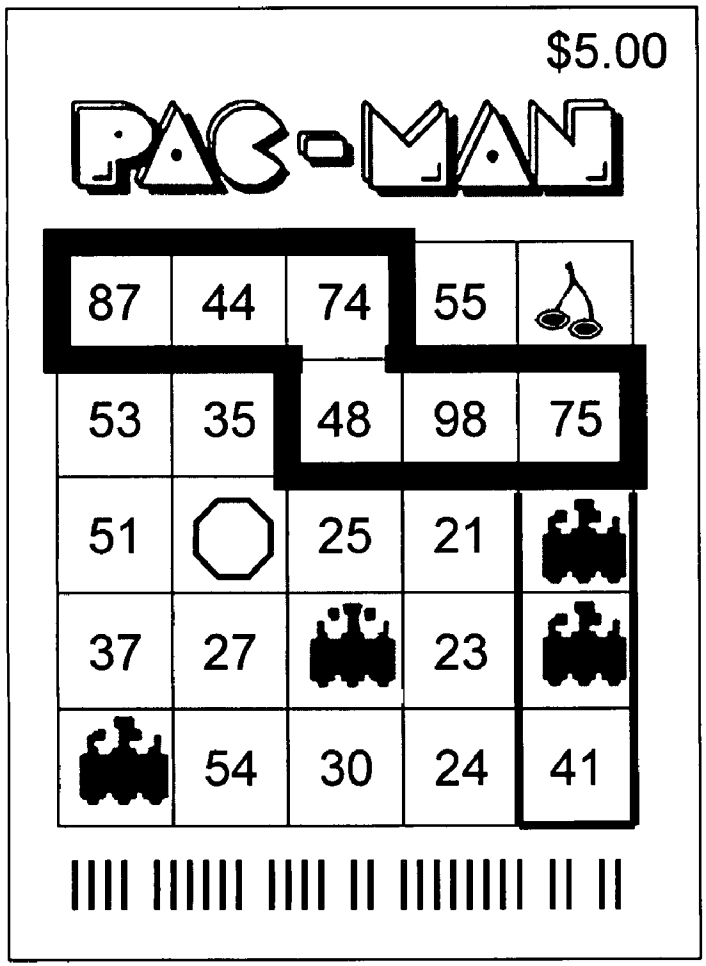

FIG. 38 is an exemplary ticket with the Power Pill. The Power Pill has been placed in the $1^{st}$ row, $3^{rd}$ column. The player wins the Power Pill as it is in the selected path. The Power Pill is worth a 2 multiplier. The player also has a CHERRIES symbol in his path, which is worth a 2 multiplier. Also, as the player has won the Power Pill, it is conferred immunity to the ghosts. The ghosts, now with a different appearance, evocative of the arcade game, to indicate that they are now "edible." Each ghost that occurs in the selected path is worth a 2 multiplier. All of the player's multipliers are multiplied together to produce a final multiplier: 2 (Power Pill)×2 (CHERRIES)×2×2 (the two ghosts)=16. Therefore, the player will have 16 multiplied to his winnings. The player's numbers are 87, 33, 67, 47, and 41. The lottery authority draws 4 numbers out of 100 and the player wins prizes based on matches between his numbers and those drawn by the lottery. FIG. 39 is another exemplary ticket for this embodiment. The Power Pill is in the position $3^{rd}$ row, $2^{nd}$ column; however, the play does not win the Power Pill as it is not in the selected path. It does not have immunity to the ghosts and is obstructed.

This base game prize table for this embodiment is in FIG. 40. Notice that the prizes are the same as for those for the previous embodiment, which had a $2.00 price point. This is convenient as this would allow the two embodiments, one priced at $2.00 and the other priced at $5.00, to be run concurrently using the same draw and prize table. However, the $5.00 game also features a minimum prize of $7. This means that if a player wins a prize, then he is awarded the maximum of his prize and $7. This is appealing to the player as it guarantees that if he wins a prize, it will at least be as big as the price point. For example, suppose the draw is 41, 45, 50, and 87. As the ticket in FIG. 38 has two matches, it is awarded $10. Also, as discussed it has final multiplier (factoring in the Power Pill, CHERRIES symbols, and ghosts) of 16. The final prize is $160. The ticket in FIG. 39 has 1 match, 87 and is awarded $2. As there is a minimum prize of $7, his final prize is $7. Those skilled in the art of Mathematics can verify that this embodiment pays out 64.0%. A composite prize table is indicated in FIG. 41.

Figure 42:
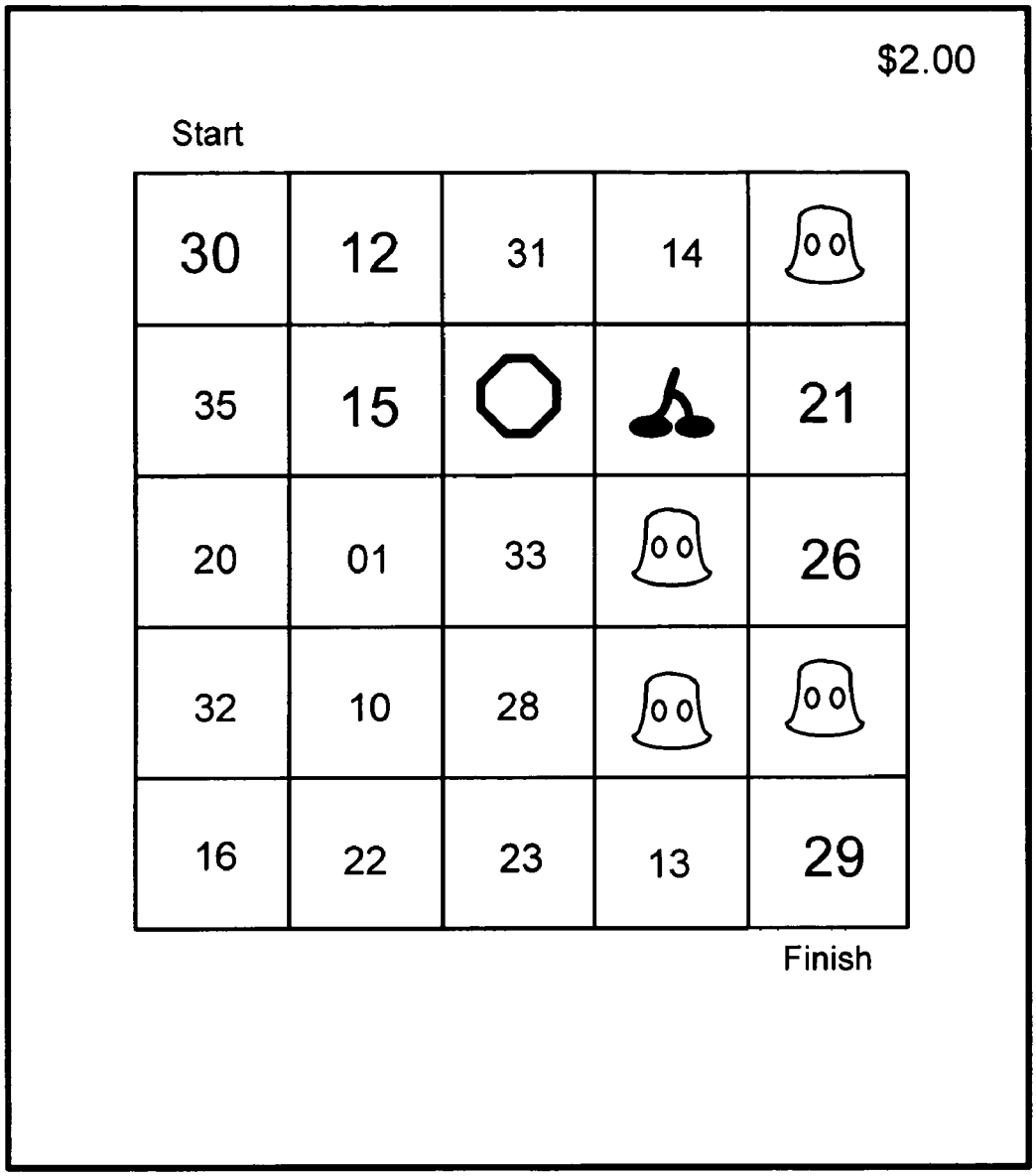
FIG. 42 illustrates another sample ticket according the invention.

The current invention could be embodied with virtually any matrix, such as that for Keno, wherein 20 numbers are drawn from the set 1 to 80. FIG. 42 is a sample ticket. A ticket costs $5.00 and comprises 5 by 5 grid that is populated by numbers ranging from 1 to 80, a Power Pill symbol, a fruit symbol, and 4 ghosts. The Power Pill symbol, fruit symbol, and 4 ghosts are placed on the grid similar to earlier embodiments. In this embodiment, the Power Pill does not award a multiplier, but does confer immunity to the ghosts and the fruit symbol is always worth a 3 multiplier. Each ghost, if eaten, is worth a 2 multiplier. An exemplary base prize table is in FIG. 43. Notice that prizes are awarded for up to 9 matches. Nine matches are possible as it is possible for the player to have as many as 9 numbers in his path and the lottery authority draws 20 numbers. Those skilled in the art of Mathematics can confirm that this embodiment pays out 64.9% and the player has a 1 in 5.5 chance of winning a prize.

Figure 44:
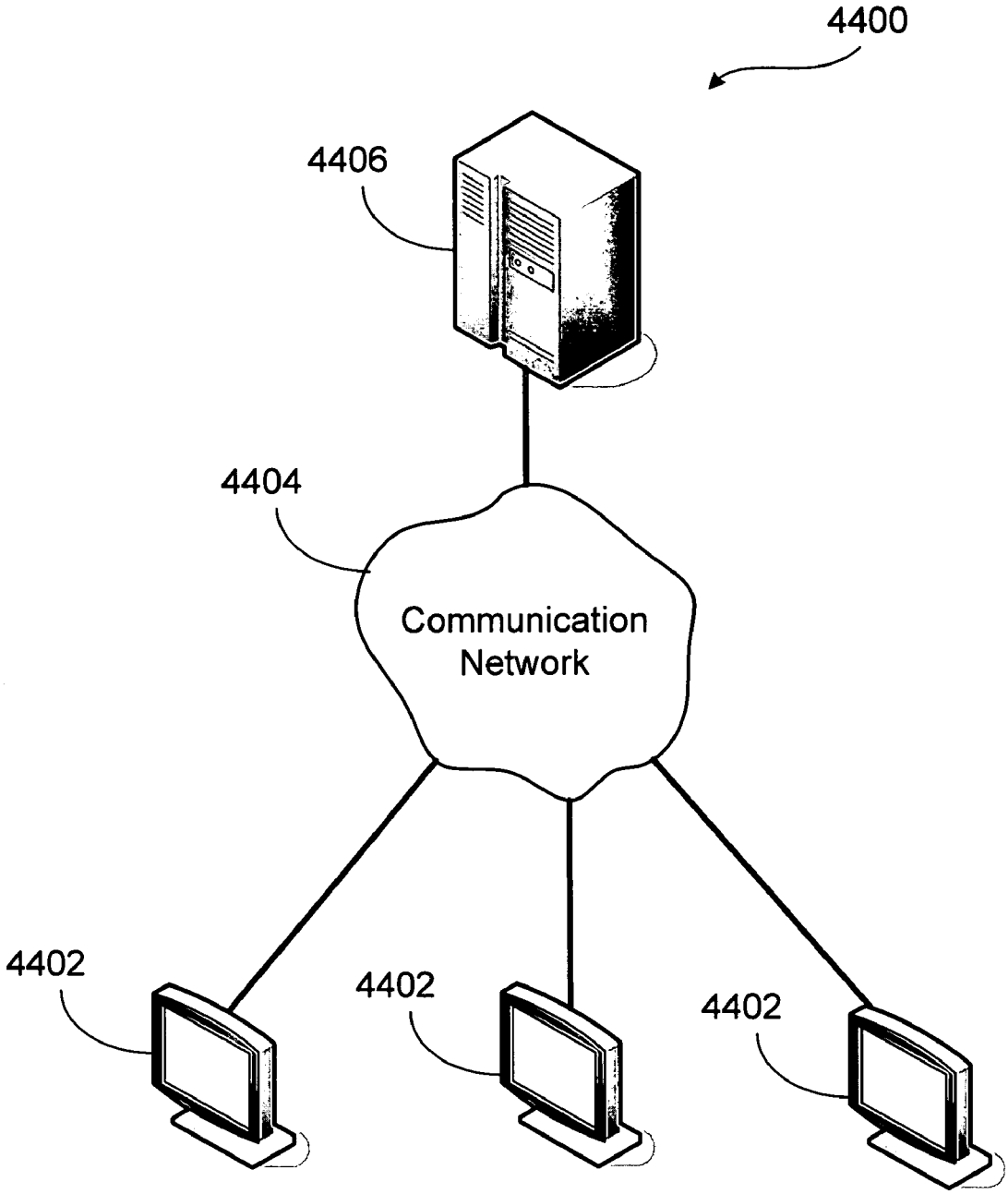
FIG. 44 illustrates a network supporting the present invention

The invention can be implemented on a standalone gaming device or a game server. A standalone gaming device may include a display unit, a scanning unit (also known as a player input device) for scanning playslips containing player selection, and a ticket issuing unit for issuing tickets to players. The gaming device has a controller with a random number generator capable of generating numbers for the player. The controller also takes player selected path and numbers from the scanning device and issues a ticket to the player. After issuing the ticket, the controller generates a set of winning numbers and placement of ghosts, and determines a number of matches for the player's ticket as described above. The gaming device may also be connected to a game server as illustrated in FIG. 44. The gaming device 4402 is connected to the server 4406 through a communication network 4404. In the embodiment illustrated in FIG. 44, each gaming device receives wagers and selections from players, passes betting information to the server 4406, and issues tickets to the players. The server 4406 receives player selections and determines winners based on the numbers selected by the lottery authority.

Figure 45:
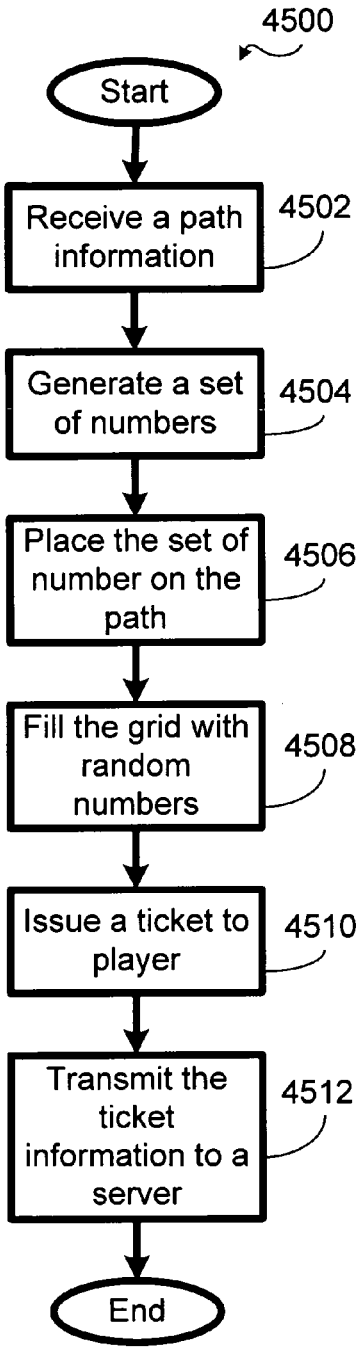
FIG. 45 illustrates a game device process.

FIG. 45 illustrates a lottery station process 4500 according to one embodiment of the invention. A player may select a path on a grid and submit his selected path to a lottery station. The lottery station receives this path information, step 4502, and randomly generates a set of numbers, step 4504, and places each number on a position in the selected path, step 4506. Alternatively, the player may also select numbers and their placement on the selected path. After filling each position of the selected path with generated numbers, the lottery station will fill the rest of the grid with random numbers, step 4508, and print a ticket corresponding to this grid and player's path to the player, step 4510. Additionally, upon payment of additional fee, the player may also request a Power Pill be randomly placed on the selected path. The player's selected path and the generated numbers for the selected path are sent to a lottery server where it will be stored, step 4512.

Figure 46:
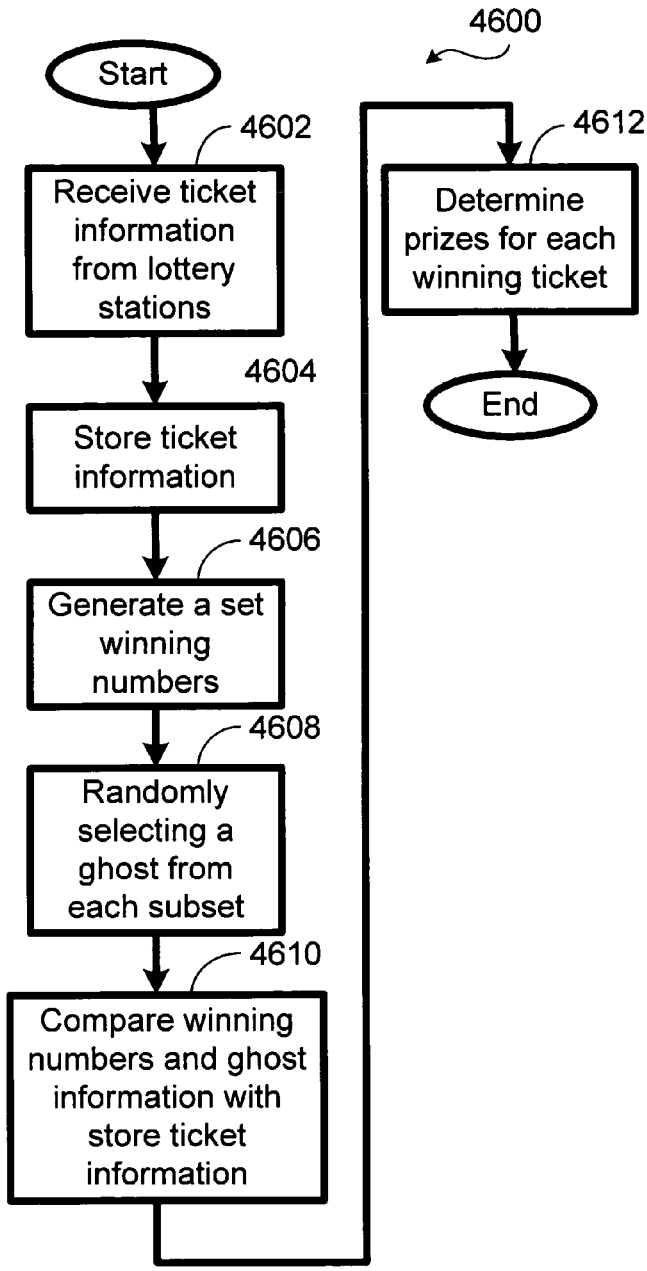
FIG. 46 illustrates a lottery server process.

FIG. 46 illustrates a lottery server process 4600. The lottery server receives ticket information from lottery stations, step 4602, and store the ticket information, step 4604. Subsequently, the lottery will draw or generate a set of winning numbers, step 4606, and also randomly placing a set of ghosts on the grid, one ghost on each subset as described above, step 4608. The winning numbers and the placement of the ghosts are made public. The lottery server may also compare winning numbers and the ghost information with the stored ticket information, step 4610, and determine prizes for each winning ticket, step 4612.

Although several preferred embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed herein, and that many modifications and other embodiments of the inventions are intended to be included within the scope of the appended claims. Moreover, although specific terms are employed herein, as well as in the claims, they are used in a generic and descriptive sense only, and not for the purposes of limiting the described invention, nor the claims which follow below.

What is claimed is:

1. A method for hosting a lottery game, comprising the steps of:

designating a plurality of game player positions on a predetermined grid presented to the player on a play slip, the game player positions defining a pathway on the grid, said pathway including all of the player positions and being linear and continuous from a first grid position to a second grid position wherein;

issuing a lottery ticket to the player that indicates the player's pathway on the grid;

the lottery authority randomly selecting at least one position on said grid; and determining an outcome of the game based on the intersection of the pathway indicated on the player's lottery ticket and the at least one randomly selected position on the grid.

2. The method of claim 1, the step of randomly selecting at least one position on the grid further comprising the step of randomly selecting a plurality of positions from a plurality of separate subsets of positions defined on said grid, wherein the number of subsets is equal to the number of randomly selected positions, and only one position is selected from each of the subsets.

3. The method of claim 1, further comprising the step of awarding a game prize to the game player based on the game outcome as a function of where the pathway is intersected by one of the randomly selected positions.

4. The method of claim 3, wherein the game prize is based on the number of positions in the pathway from the start position to intersection of the pathway by one of the randomly selected positions.

5. The method of claim 3, further comprising the step of randomly assigning player indicia to the grid positions for the player and displaying the randomly assigned player indicia on the lottery ticket issued to the player, the game outcome being a function of the player indicia identified by the pathway up to a first position on the pathway intersected by one of the randomly selected positions.

6. The method of claim 5, further comprising the steps of randomly producing a set of lottery indicia and awarding prizes based on the number of matches between the lottery indicia and the player indicia indentified by the pathway.

7. The method of claim 1, wherein the lottery authority's random selection of grid positions occurs at the time of game entry and is indicated on the lottery ticket issued to the player that also indicates the player's pathway of player positions.

8. The method of claim 1, wherein the lottery authority's random selection of grid positions comprises an event that applies to multiple players and is not indicated on the lottery ticket issued to the player that indicates the player's pathway of player positions.

* * * * *